US007608034B2

(12) United States Patent
Parker et al.

(10) Patent No.: US 7,608,034 B2
(45) Date of Patent: Oct. 27, 2009

(54) STACK CONDITIONING APPARATUS AND METHOD FOR USE IN BOOKBINDING

(75) Inventors: Kevin P. Parker, Berkeley, CA (US); Harold P. Hocking, Manhattan Beach, CA (US)

(73) Assignee: Powis Parker Inc., Berkeley, CA (US)

( * ) Notice: Subject to any disclaimer, the term of this patent is extended or adjusted under 35 U.S.C. 154(b) by 25 days.

(21) Appl. No.: 11/361,692

(22) Filed: Feb. 24, 2006

(65) Prior Publication Data

US 2007/0203008 A1 Aug. 30, 2007

(51) Int. Cl.
*B42C 5/04* (2006.01)

(52) U.S. Cl. ..... 493/409; 493/372; 493/408; 493/352

(58) Field of Classification Search ..... 493/405, 493/422, 434, 435, 442, 210, 223, 340, 352, 493/356, 372, 408, 409
See application file for complete search history.

(56) References Cited

U.S. PATENT DOCUMENTS

| | | | | |
|---|---|---|---|---|
| 1,642,866 A | | 9/1927 | Ackley | 144/136.1 |
| 2,646,726 A | | 7/1953 | Fogg | 409/185 |
| 4,182,186 A | | 1/1980 | Hirsch | 83/468.8 |
| 4,332,582 A | * | 6/1982 | Hertrich | 493/424 |
| 4,717,236 A | | 1/1988 | Dewing | 385/109 |
| 4,960,295 A | * | 10/1990 | Bodouroglou | 281/15.1 |
| 5,044,857 A | | 9/1991 | Crudo | 412/19 |
| 5,094,660 A | * | 3/1992 | Okuzawa | 493/320 |
| 5,152,937 A | * | 10/1992 | Tetu | 264/437 |
| 5,383,755 A | | 1/1995 | Hassig et al. | 412/16 |

(Continued)

FOREIGN PATENT DOCUMENTS

| | | | |
|---|---|---|---|
| CA | 991219 | 6/1976 | 281/6 |

OTHER PUBLICATIONS

InstaBook, "*Book on Demand Binding*", 1 page, downloaded from the Internet on Feb. 10, 2004 from http://www.instabook.net/binding.html.

(Continued)

*Primary Examiner*—Christopher Harmon
(74) *Attorney, Agent, or Firm*—Girard & Equitz LLP

(57) ABSTRACT

Apparatus and method for conditioning an edge of a sheet to be bound so that the edge is conducive to accepting heat activated adhesives used in conventional binding. The sheet is first bent in one direction to form a folding line, with the fold line being a short distance from the edge of the sheet to be conditioned and with that distance being determined primarily by the thickness of the sheet. The bend in the sheet is typically 90 degrees, with the radii of curvature of the opposite sheet surfaces at the fold line being unequal so that a shear force is applied near the sheet end thereby tending to tear or fracture in interior of the sheet near the end. Typically the sheet is then bent in an opposite direction along the folding line so as to produce an opposite shear force that reinforces the creation of tears and fractured in the sheet. These tears and fractures in the sheet greatly enhance the adhesion of binding adhesives to the sheet, particularly sheets having coatings used in photographic applications and the like.

45 Claims, 19 Drawing Sheets

U.S. PATENT DOCUMENTS

| | | | | |
|---|---|---|---|---|
| 5,961,268 | A | 10/1999 | Jäger | 412/1 |
| 6,012,890 | A | 1/2000 | Celorio Garrido | 412/19 |
| 6,053,684 | A * | 4/2000 | Eckert et al. | 412/1 |
| 6,209,291 | B1 * | 4/2001 | Delen et al. | 53/450 |
| 6,213,703 | B1 | 4/2001 | Garrido | 412/19 |
| 6,602,176 | B1 * | 8/2003 | Ganneval | 493/405 |
| 6,641,345 | B2 * | 11/2003 | Cobene et al. | 412/1 |
| 2005/0173856 | A1 * | 8/2005 | Parker et al. | 270/58.07 |
| 2007/0086875 | A1 * | 4/2007 | Parker et al. | 412/9 |

OTHER PUBLICATIONS

Patent Publication No. US 2005/0173856 A1, published Aug. 11, 2005, Parker, et al.

U.S. Appl. No. 11/219,342, filed Sep. 2, 2005 and entitled "Conditioned Sheets for Binding and Method/Apparatus for Making Same".

PCT Publication No. WO 99/39917, Publication Date Aug. 12, 1999.

* cited by examiner

FIG. 10C
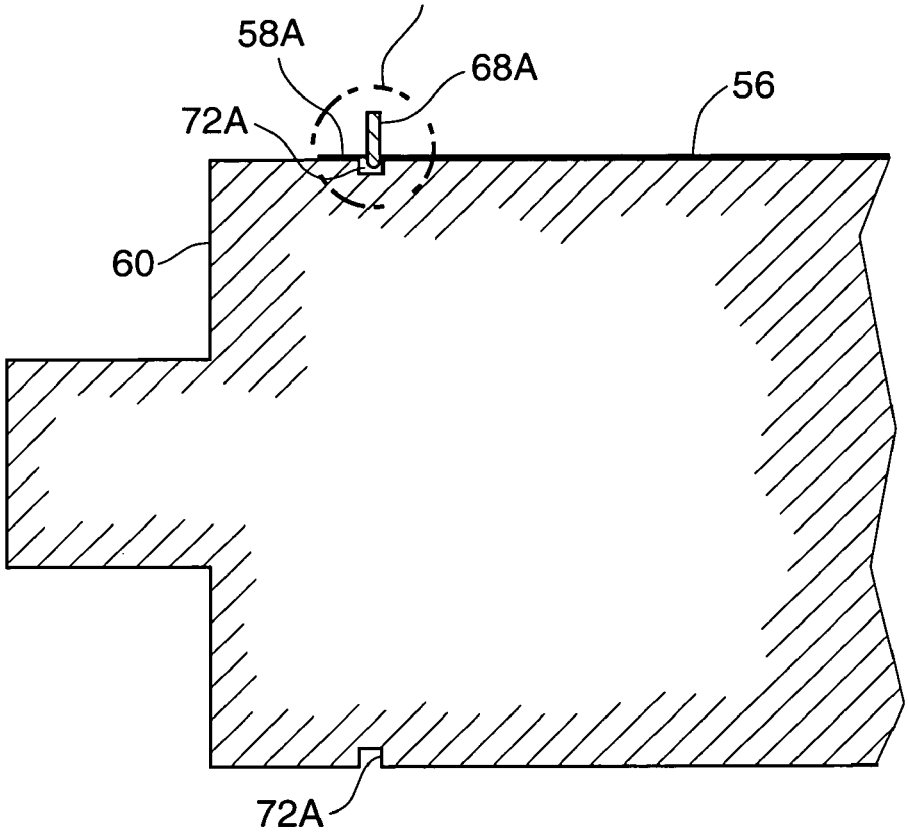
FIG. 10B
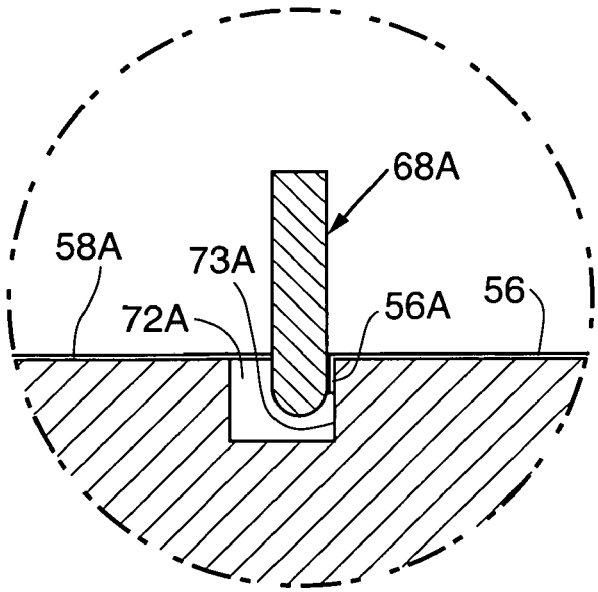
FIG. 10C

STACK CONDITIONING APPARATUS AND METHOD FOR USE IN BOOKBINDING

BACKGROUND OF THE INVENTION

1. Field of the Invention

The present invention relates generally to the field of bookbinding and in particular to apparatus for preparing a stack of sheets to be bound for binding.

2. Description of Related Art

Bookbinding apparatus have been developed which permits stacks of sheets to be bound using thermally activated adhesive binder strips. Such binder strips are typically applied using relatively low cost desktop binding machines such as disclosed in U.S. Pat. No. 5,052,873, the contents of which are also incorporated herewith by reference. Referring to the drawings, FIG. 1 shows a binder strip 20 disposed adjacent the insertion point 30A of a conventional binding machine 30. A user first inserts a stack of sheets 32 to be bound in an upper opening of the machine. Controls 30B are then activated to commence the binding process. The binding machine operates to sense the thickness of the stack 32 and indicates on a machine display 30C the width of binder strip 20 to be used. Typically, three widths can be used, including wide, medium and narrow. The binder strip includes a flexible substrate 20A having a length that corresponds to the length of the edge of the stack 32 to be bound and a width somewhat greater than the thickness of the stack. A layer of heat-activated adhesive is formed on one side of the substrate, including a low viscosity, low tack central adhesive band 20C and a pair of high viscosity, high tack outer adhesive bands 20B.

Once the user has selected the binder strip of appropriate width, the user manually inserts the strip 20 into the strip loading port 30A of the machine. The end of the strip, which is positioned with the adhesive side up, is sensed by the machine and is drawing into the machine using an internal strip handling mechanism. The machine then operates to apply the strip to the edge of the stack to be bound. The strip is essentially folded around the edge of the stack, with heat and pressure being applied so as to activate the adhesives. Once the adhesives have cooled to some extent, the bound book is removed from the binding machine so that additional books can be bound. FIG. 2 depicts a partial end view of the bound stack 32. As can be seen, the substrate 20A is folded around the bound edge of the stack. The high tack, high viscosity outer adhesive bands 20B function to secure the strip to the front and back sheets of the stack. These sheets function as the front and rear covers and can be made of heavy paper or the like. The central, low viscosity adhesive 20C functions to secure the individual sheets of the stack by flowing up slightly between the sheets during the binding process.

Although the above-described binding technique provides a reliable bind in most applications, problems arise when the sheets of the stack have special coatings. Such coatings are applied to the sheets for various purposes to enhance the characteristics of the sheet, such as improving the ability of the sheet to receive special printing inks. In any event, such coatings very frequently prevent the central adhesive 20C from adhering adequately to the individual sheets of the stack. This results in an unsatisfactory bind where sheets frequently separate from the stack. Various approaches have been used to address this problem. One approach is to use different types of adhesive for the central adhesive 20C. Another approach is to texturize the stack of sheets prior to binding so that the adhesive is more likely to accept the central adhesive. By way of example, in U.S. Pat. No. 5,961,268 entitled "Method and Device for Adhesive Binding of Printed Products", a rotating wire brush is applied to the edge of a stack of sheets prior to binding. This approach has not been found satisfactory in addressing the problems relating to coated papers. As a further example, prior art binding systems commonly referred to as perfect binding incorporate milling apparatus that grinds or mills the edge of a stack to be bound. However, stacks of coated sheets processed in this manner cannot be reliably bound using most thermal activated adhesives. Further, such milling results in the production of debris that must be removed and disposed of during the subsequent binding process.

There is a need for an apparatus and method for conditioning a stack of sheets, prior to binding, that will permit the stack to be reliably bound using conventional thermal adhesive binder strips as previously described. As will be apparent to those skilled in the art upon a reading of the following Detailed Description of the Invention together with the drawings, the present invention meets these and other requirements. Once a stack of coated sheets has been conditioned in accordance with the present invention, a reliable bind can be achieved using conventional relatively low cost desktop binding equipment and binder strips.

BRIEF DESCRIPTION OF THE DRAWINGS

FIG. 10B is a cross-sectional view of a grooved roller of the FIG. 10A apparatus showing a groove in the drum for bending one web edge in one direction.

FIG. 10C is an enlarged portion of FIG. 10A.

DETAILED DESCRIPTION OF THE INVENTION

Figure 1:
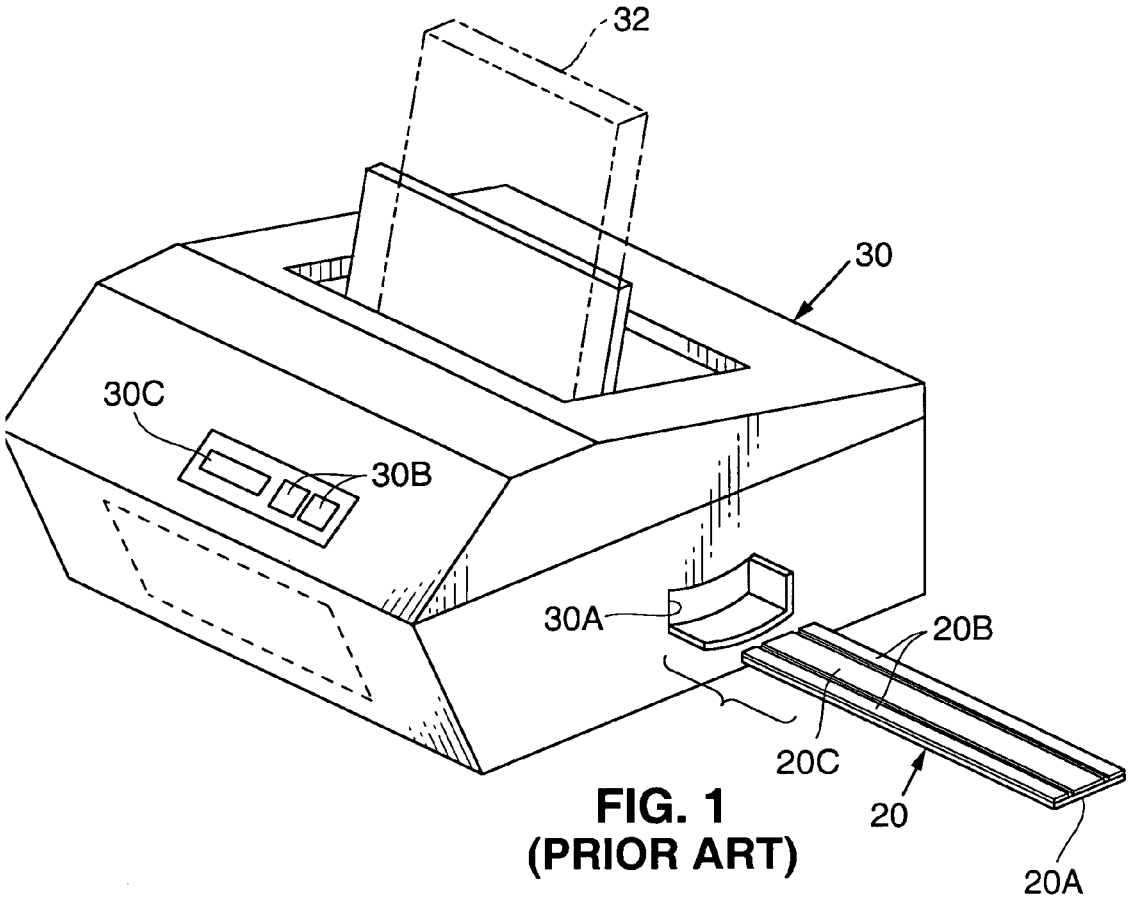
FIG. 1 (PRIOR ART)
FIG. 1 is a perspective view of a conventional binding machine for use in binding stacks of sheets, including stacks conditioned in accordance with the present invention.
Figure 2:
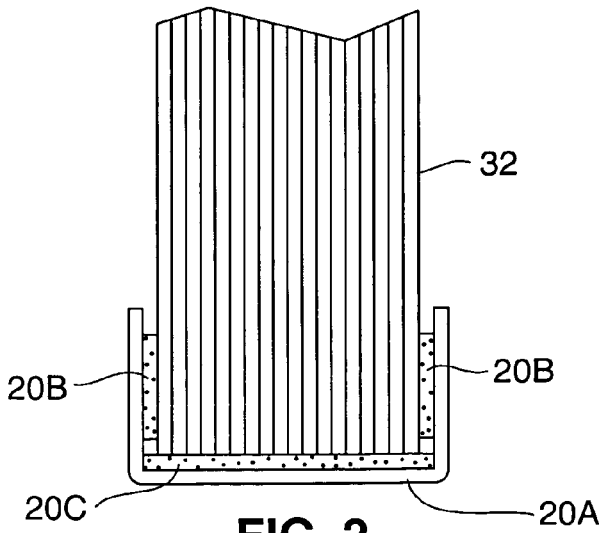
FIG. 2 (PRIOR ART)
FIG. 2 is an end elevational view of a stack of sheets bound by conventional thermally activated adhesive binder strips using the binding machine of FIG. 1.

Apparatus and related methods are disclosed for conditioning a sheet of paper, or a web of paper to be cut in sheets, so that such sheets can be readily bound using, for example, the apparatus of FIGS. 1 and 2. This includes sheets made of paper, such as coated sheets, which heretofore have been difficult to bind using thermoplastic adhesives. Many details of the manner in which the conditioning apparatus is implemented are not depicted or described because such details are well within the grasp of persons skilled in the art upon a reading the present description of the apparatus and its operation. Also, disclosure of such details may obscure the true nature of the present invention. There may be instances where opposite edges of a sheet are both conditioned, with only one edge being bound in which case one of the conditioned edges will remain exposed. Thus, it is preferable that the conditioning not be readily apparent, with this objective being achievable using the present invention.

Figure 3A:
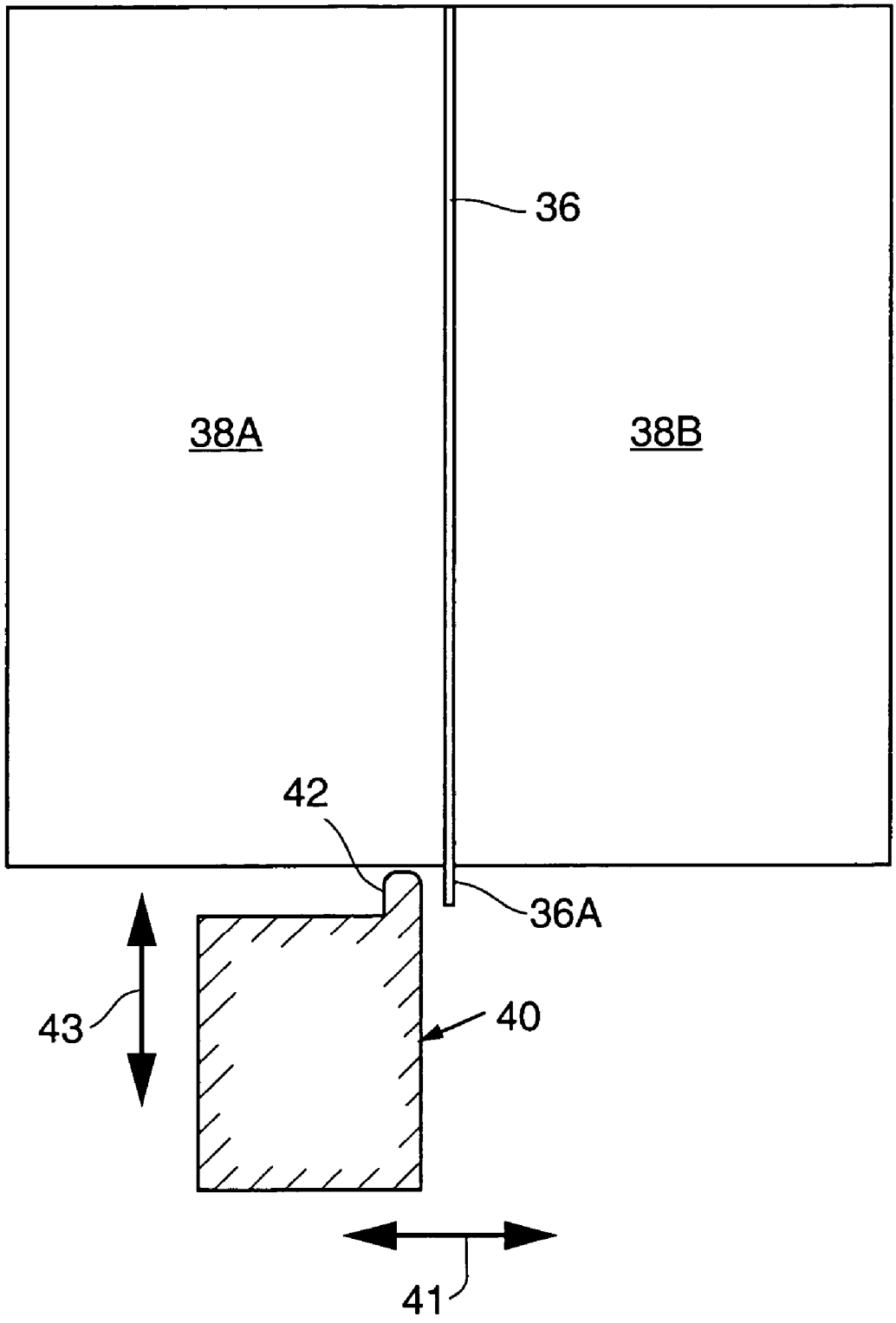
FIG. 3A illustrates an initial step in the process of conditioning a cut sheet of paper in accordance with one aspect of the present invention where a bending member is positioned adjacent a sheet to be conditioned.
Figure 3B:
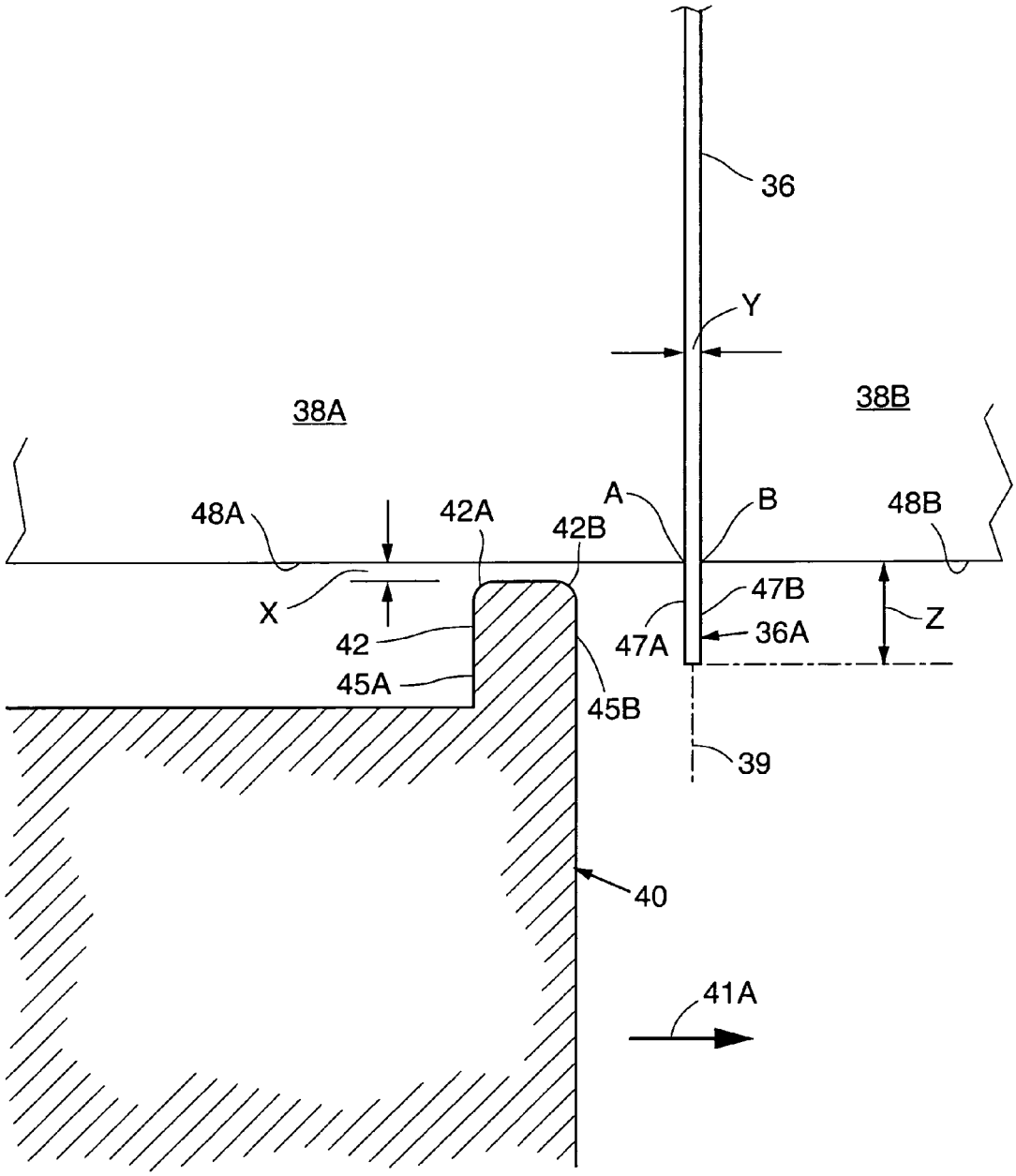
FIG. 3B is an expanded view of a portion of FIG. 3A.

Referring again to the drawings, FIGS. 3A and 3B are schematic representations of a conditioning apparatus for conditioning a cut sheet of paper in accordance with one embodiment of the present invention. A cut sheet 36 of paper to be conditioned is first positioned between a pair of clamps 38A and 38B, with the clamps then being closed so as to securely grip the sheet. The clamps are movable between an open position (not depicted) for receiving the sheet to be conditioned and a closed position where the sheet is secured between the clamps. A small length 36A of the sheet to be conditioned is exposed. Segment 36A of sheet 36 is sometime referred to herein as the protruding section 36A. Section 36A is shown in an original position 39 (FIG. 3B), with that position being aligned with the remainder of the sheet 36 disposed between the clamps 38A and 38B. The length Z (FIG. 3B) of the protruding section 36A is a function primarily of the thickness Y of the sheet 36. For example, a typical sheet of photograph type paper is typically 0.008 inches thick in which case the protruding section 36A is approximately 0.030 to 0.050 inches. For thinner sheets, the length Z of 36A needs to be shorter, with the ratio of section 36A length Z to sheet 36 thickness Y (Z/Y) typically being in a range of approximately 4 to 6. Preferably, the ratio of the length Z of the protruding section 36A to the thickness Y of the sheet is no greater than twenty (20). The movable clamps 38A/38B together with other components thus function as a positioning mechanism to secure the sheet 36 in the position depicted in FIG. 3B with the protruding section 36A extending distance Z.

A bending member 40 is provided which moves relative to the sheet 36 so as to bend or fold the protruding sheet section 36A first in one direction and then in the opposite direction, as will be described. This folding typically takes place at a common folding line, with the spacing of the folding line from the end of the sheet defining the width of the protruding section 36A. In order to achieve this relative movement represented by arrow 41, it would be possible to keep the sheet 36 in a fixed location and move the bending member 40, move the sheet while keeping the member 40 fixed or a combination of both. In addition to moving in a direction normal to the sheet 36, the binding member 40 is also preferably capable of movement parallel the sheet as indicated by arrow 43 (FIG. 3A). The member 40 is biased by a spring or the like (not depicted) having a home position proximate the two clamps 38A and 38B and spaced a distance X (FIG. 3B) from surfaces 48A/48B the clamps, with distance X being sufficiently large to ensure that the member does not contact the clamps when moving laterally in the direction of arrow 41. In addition, for reasons that will be explained, the distance X is smaller than the thickness Y of the thinnest sheet 36 anticipated to be conditioned.

Figure 4A:
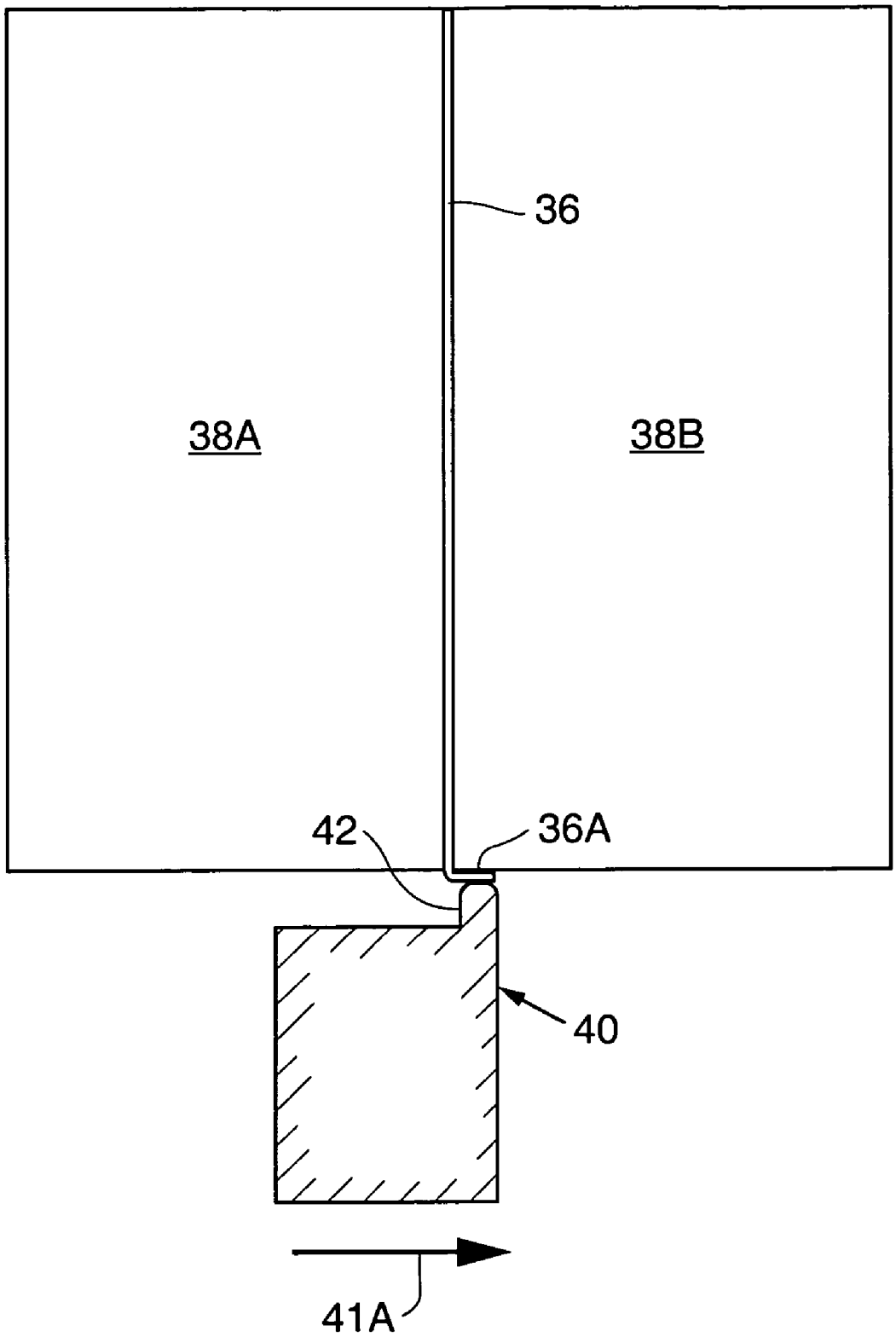
FIG. 4A illustrates a further step in the process of conditioning a cut sheet of paper in accordance with one aspect of the present where the bending member has moved to the right thereby folding the edge of the sheet being conditioned.
Figure 4B:
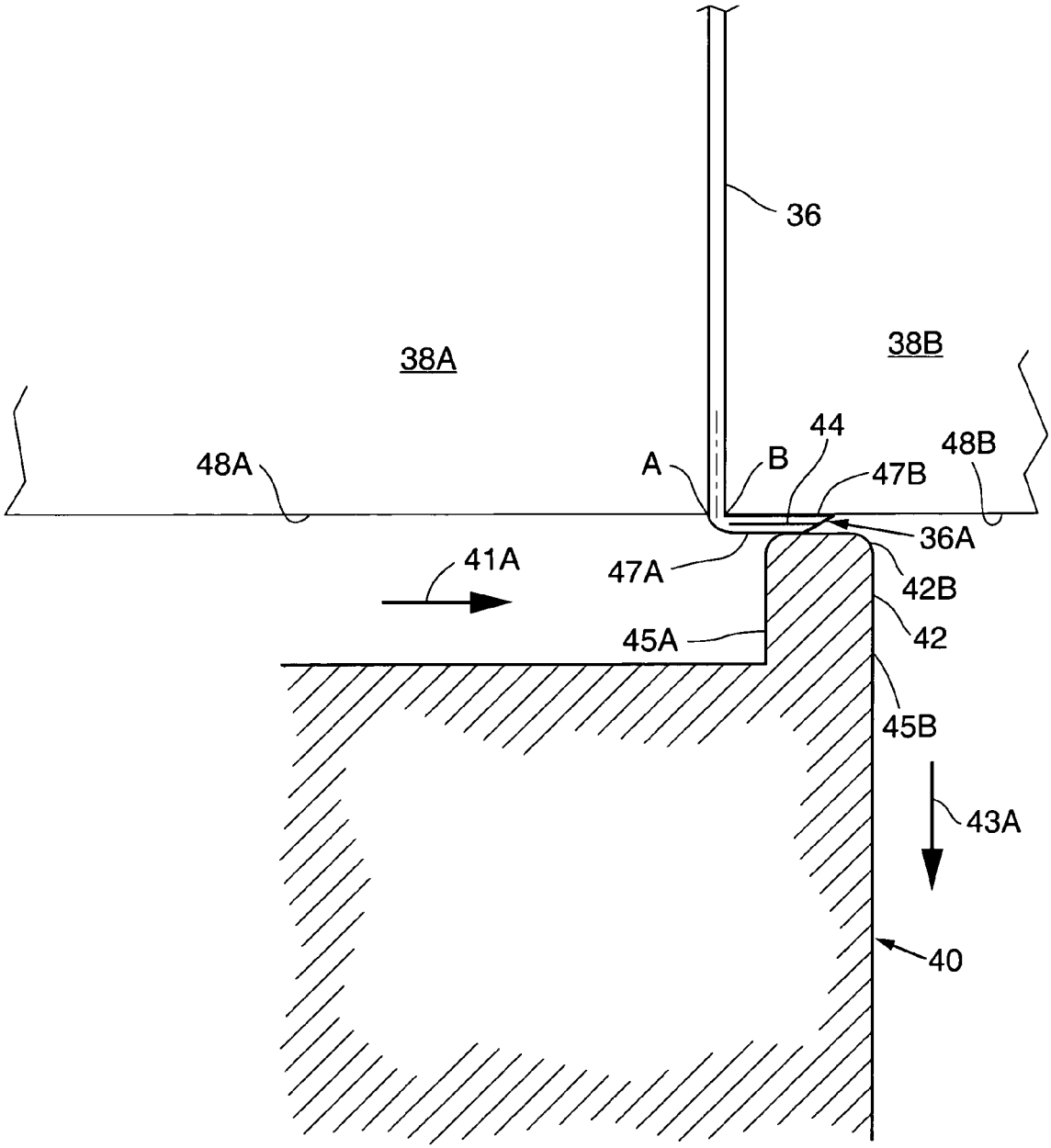
FIG. 4B is an expanded view of a portion of FIG. 4A.
Figure 4C:
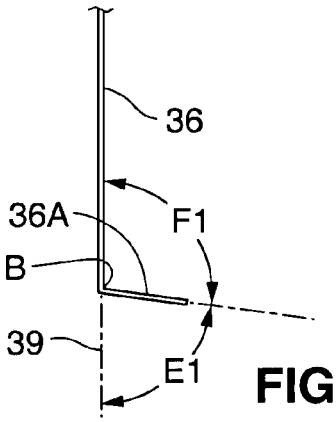
FIG. 4C is a schematic illustration of the angle E1 between the original straight sheet edge protruding section prior to bending and the position of the sheet protruding section during the final stage of bending in a first direction, with the protruding section tending to move to the original position after the bending force has been removed.

As can best be seen in FIG. 3B, the bending member 40 includes a bending blade 42 which extends away from the body of member 40 and includes a pair of rounded surfaces 42A and 42B to assist in bending or folding the protruding section 36A. The body member 40 is first driven in a direction indicated by arrow 41A (FIG. 3B) towards the protruding section 36A. As shown in FIGS. 4A and 4B, a first leading edge 45B of the bending blade 42 engages the protruding section 36A and proceeds to fold the sheet edge as depicted. The rounded surface 42B of the blade will cause the body member to be displaced slightly downward as indicated by arrow 43A (FIG. 4B) due to the finite thickness Y of the sheet edge. The previously noted biasing structure (not depicted) will continue to apply an upward force on the bending member 40 so that the bending member 40 will continue to apply the small upward force as the member moves, thereby causing the protruding section 36A to be tightly folded around the sharp corner B of clamp 38B. As can best be seen in FIG. 4B, this bending force causes the outer surface 47A of the section 36A to move a greater distance than the inner surface 47B of the edge due to the difference of the radii of curvature of the two surfaces. This difference in movement creates a shearing force along the relatively small length Z of the protruding section 36A thereby tending to cause the sheet to tear or fracture, primarily in the interior of the sheet intermediate sheet surfaces 47A and 47B, as represented by element 44. FIG. 4C is a schematic representation of the maximum angle E1 of deflection from the original position 39 of the protruding section 36A, with E1 being 90 degrees in the example of FIGS. 4A and 4B and with E1 preferably being at least 60 degrees. The radius of curvature of the folding edge B created by clamp 38B is selected to be relatively small, but not so small as to cut or tear the surfaces 47A and 47B of section 36A.

Alternatively, the inner gripping surface of clamp 38B could be considered a first folding surface with the lower surface 48B of clamp 38B forming a second folding surface, with the two surfaces meeting at corner B to form a folding member. It can be seen that the clamping action of clamps 38A and 38B and the movement of bending blade 42 function to fold the sheet 36 tightly around these first and second folding surfaces of the folding member. Preferably, the angle F1 (FIG. 4C) between the two folding surfaces is 90 degrees, with the intermediate angle F1 being typically less than 120 degrees. Note that the angle defined by the folding surfaces of clamp 38A can be expressed by either angle F1 as shown in FIG. 40 or by the value (360°-F1). As shown in FIG. 4C, the expression intermediate angle is meant to refer to the smaller of these two angles which is, by way of example, 90° rather than 270°.

Figure 5:
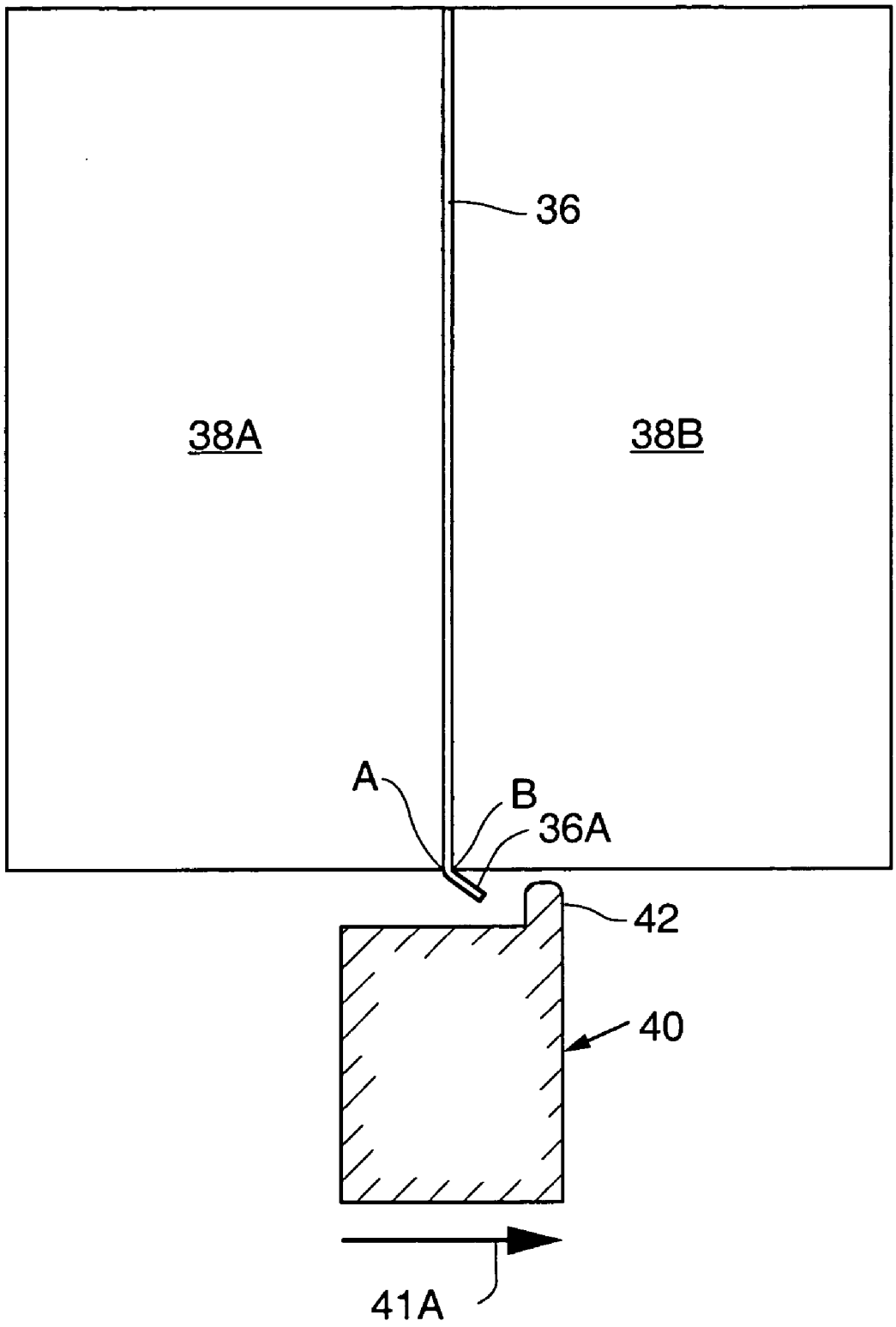
FIG. 5 illustrates a next step in the conditioning process where the bending member has moved past the folded edge of the sheet and is in positioned to move in a reverse direction.
Figure 6A:
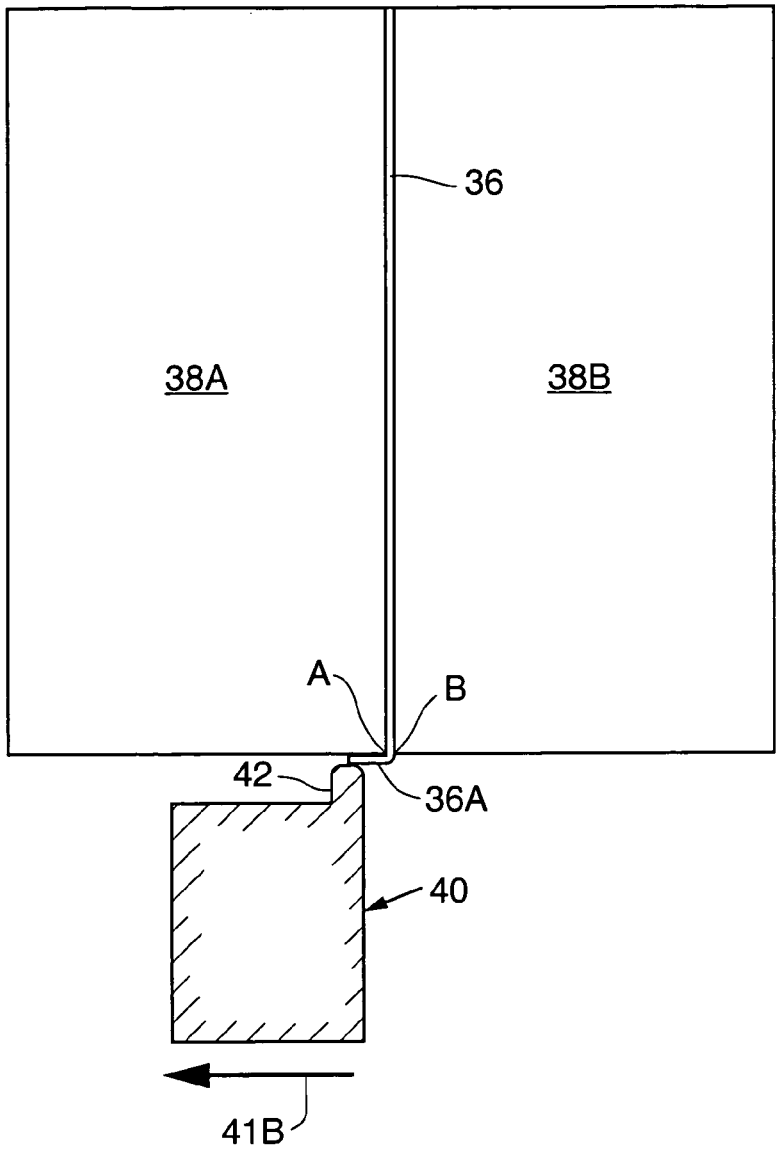
FIG. 6A illustrates a further step in the conditioning process where the bending member has moved in the reverse direction thereby folding the sheet edge in an opposite direction.
Figure 6B:
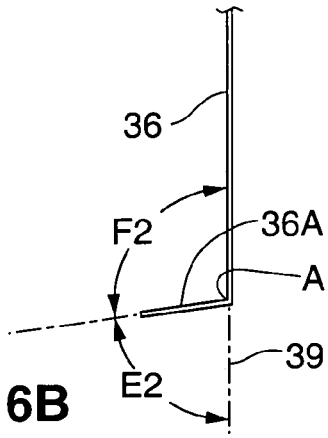
FIG. 6B is a schematic illustration of the angle E2 between the original straight sheet edge protruding section prior to bending and the position of the sheet protruding section during the final stage of bending in a second direction opposite the first direction, with the protruding section tending to move to the original position after the bending force has been removed.

As can be seen in FIG. 5, the bending member 40 is driven past the protruding section 36A so that the folded protruding section 36A is permitted to return in a direction back towards the original position 39. The absence of section 36A from between member 40 and clamp 38B permits the member 40 to moved up to the home position a distance X (FIG. 3B) from clamp 38B by the biasing mechanism. The member 40 is then driven in a reverse direction as shown in FIG. 6A and as represented by arrow 41B so that rounded edge 42A (FIG. 3B) will engage the protruding section 36A, with the biasing mechanism continuing to apply a small upward force against the protruding section 36A as the member 40 passes over the edge thereby folding the edge in an opposite direction around corner A (FIG. 4B) of clamp 38A. This action again results in a shear force to be applied to the protruding section 36A, this time in a direction opposite that of the prior bending action since surface 47B is now being forced to move a slightly greater distance than that of surface 47A due to the difference in radii of curvature. This shear force reinforces the tendency of the interior of the protruding section 36A to tear or fracture, with tear again extending all the way to the end of section 36A as represented by element 44 of FIG. 4B. FIG. 6B is a schematic representation of the maximum angle E2 of deflection from the line 39, with line 39 representing the original position of the extension 36A shown in FIG. 3B. Angle E2 is 90 degrees in the example of FIG. 6A, with E2 preferably being at least 60 degrees. Again, the radius of curvature of corner A formed by clamp 38A is selected to be small, but not so small as to damage the surfaces 47A and 47B of the protruding section 36A.

Alternatively, the inner gripping surface of clamp 38A could be considered a third folding surface with the lower surface 48A of clamp 38A forming a fourth folding surface, with the two folding surfaces meeting at corner A to form another folding member. It can be seen that the clamping action of clamps 38A and 38B and the movement of bending blade 42 function to fold the sheet 36 tightly around these third and fourth folding surfaces of the second folding member, with the surface of the sheet facing the second folding member being the opposite side facing the previously described first and second folding member formed by the inner surface of clamp 38B and the clamp lower surface 48B. Thus, the fold is in the opposite direction, as desired. Preferably, the angle F2 (FIG. 6B) between the third and fourth folding surfaces formed by clamp 38A is 90 degrees, with the intermediate angle F2 typically being less than 120 degrees. Again, as previously mentioned in connection with FIG. 4C, as shown in FIG. 6B the expression intermediate angle is meant to refer to the smaller of the two angles defined by the clamp surfaces.

Figure 7A:
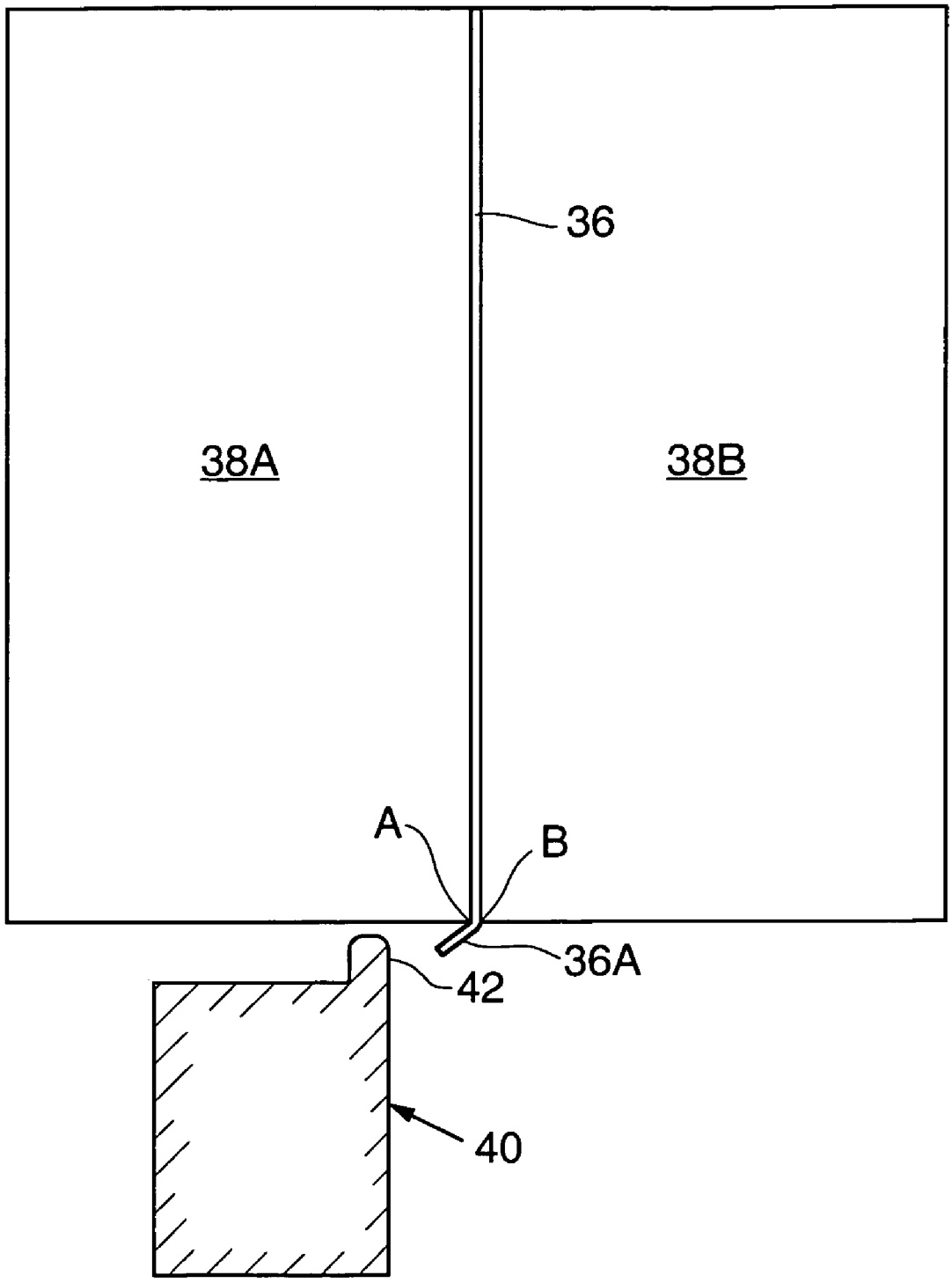
FIG. 7A illustrates still further step in the conditioning process where the bending member has completed the reverse direction pass of FIG. 6A.
Figure 7B:
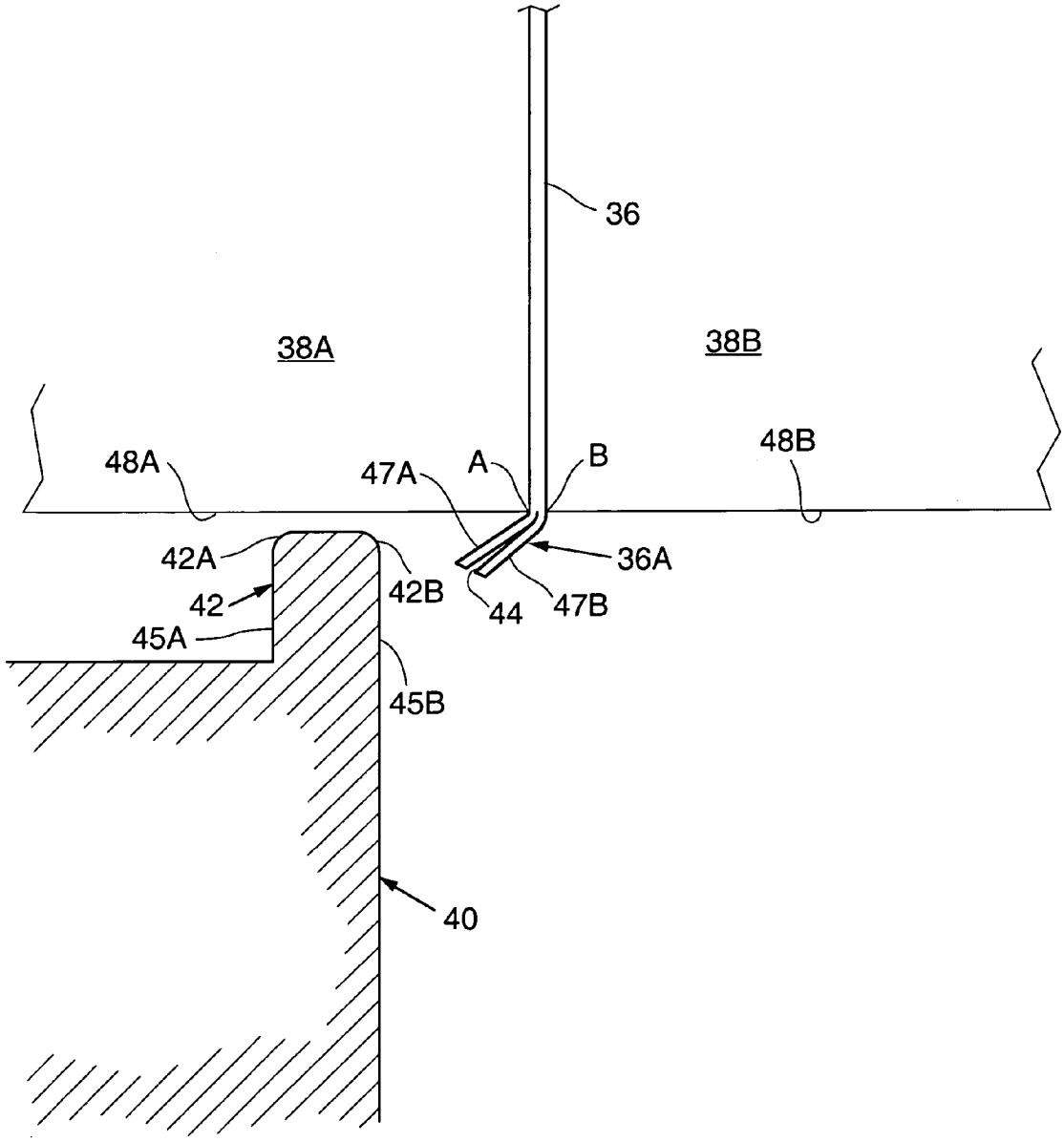
FIG. 7B is an expanded view of a portion of FIG. 7A showing details of the conditioned sheet edge.

Depending upon the nature of the paper sheet being processed and other factors, including but not limited to the Z/Y ratio, the angles E1 and E2 and the radius of curvature of corners A and B, usually one or two passes of the member 40 over the protruding section 36A is sufficient to adequately condition the sheet edge for reliable binding using conventional thermal adhesive binding techniques as described in connection with FIGS. 1 and 2. FIG. 7B shows details of the protruding section 36A after the second pass, with 44 again representing the tear or fracture in section 36A which extends all the way to the edge of the section. This fracture or tear is preferably fairly uniformly distributed along the full length of the edge of section 36A, but even a somewhat non-uniform distribution may be adequate. The tear or fracture 44 in the edge allows the molten binding adhesive to be drawn into the edge by capillary action and other mechanisms, with even the presence of a small amount of adhesive being sufficient to greatly enhance the adhesion properties of the adhesive to the edge of sheet 36.

Figure 8A:
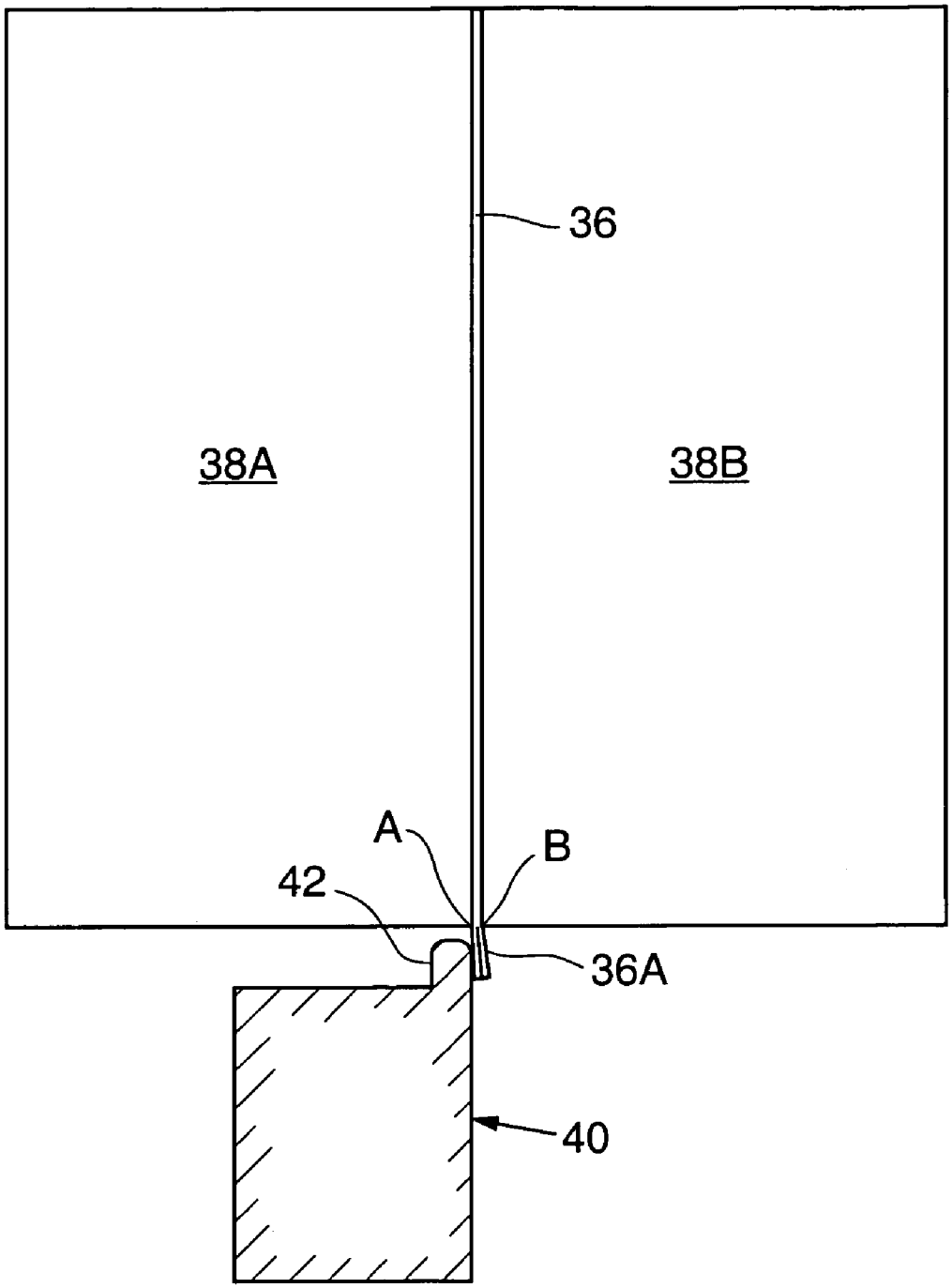
FIG. 8A illustrates a final step in the conditioning process where the bending member is returned to a position which returns conditioned edge to a straight position.
Figure 8B:
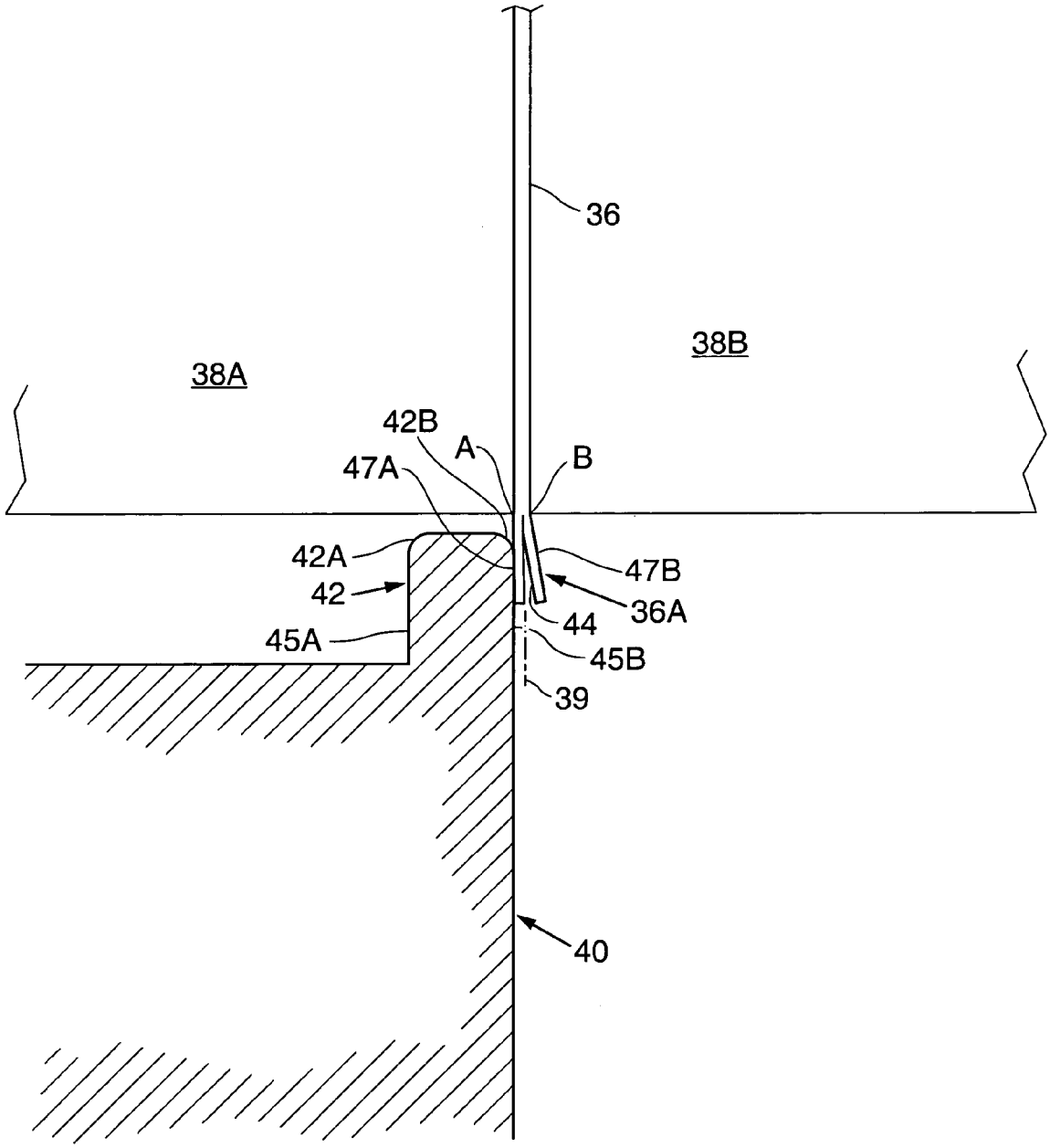
FIG. 8B is an expanded view of FIG. 8A.

Once a sufficient number of passes by member 40 have occurred, member 40 stops at a predetermined location as shown in FIGS. 8A and 8B. When stopped, and edge 45B of bending blade 42 of the member forces the conditioned section 36A back to approximately the original position 39 (FIG. 3B).

Once the edges of all of the sheets 36 to be bound have been conditioned, the sheets are formed into a stack 32 for binding as shown in FIGS. 1 and 2 with all of the conditioned edges being positioned in common. As previously noted, the split edges of the sheets tend to absorb the molten adhesive during binding thereby insuring a very reliable bind, even for paper types that would otherwise not accept the adhesive.

Figure 9A:
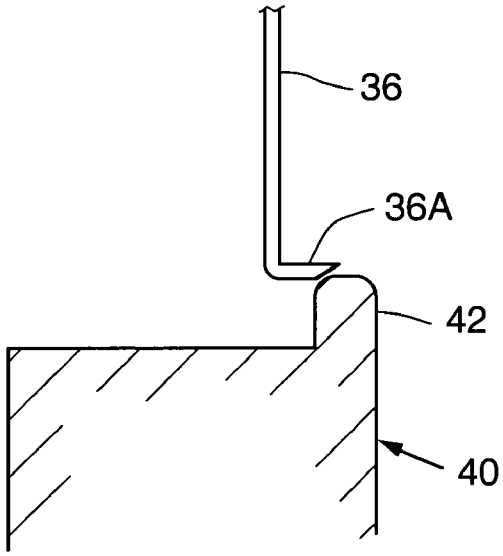
FIGS. 9A and 9B are respective elevational and plan views conditioned sheet and the bending member, with FIG. 9B illustrating a preferred small angle H between the sheet and the bending member.
Figure 9B:
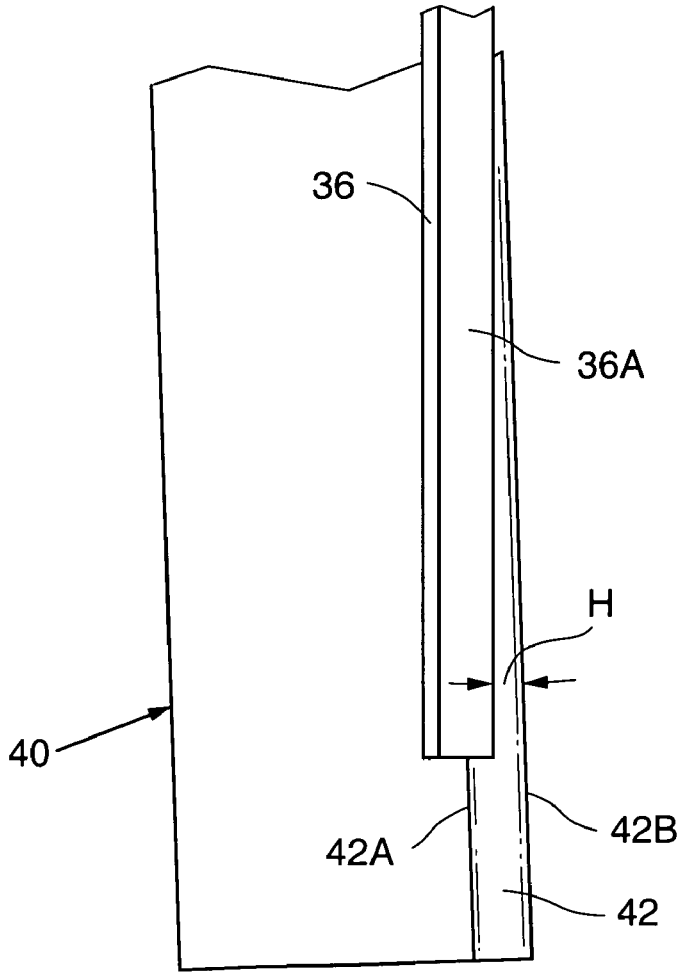

The amount of force required to condition a sheet 36 can be substantially reduced by applying the bending force at an angle with respect to the plane of the sheet. This permits a smaller drive motor to be used thereby reducing the cost of the conditioning machine along with the size of the machine for desktop applications. FIGS. 9A and 9B are side and plan schematic views of a typical arrangement for applying the bending force at an acute angle H to the sheet. The clamps 38A and 38B are not shown for purposes of clarity. Depending upon the size of angle H, the maximum amount of force required to drive member 40 in either direction 41A or 41B is decreased, while the distance that member 40 is required to move is increased accordingly.

Figure 10A:
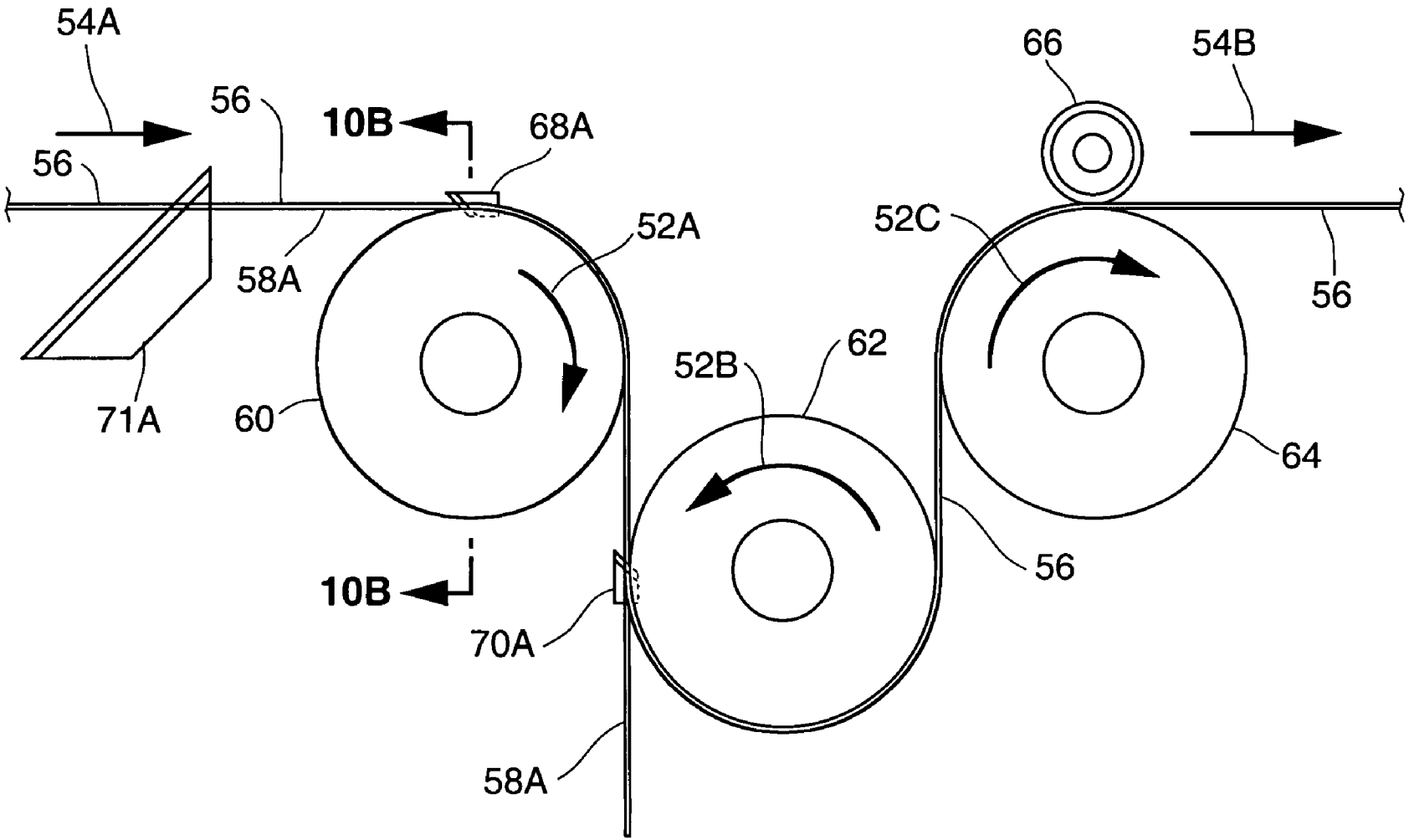
FIG. 10A is a side schematic view of an apparatus for continuously conditioning the edges of a paper web to be subsequently cut into individual sheets in accordance with another embodiment of the present invention.
Figure 11:
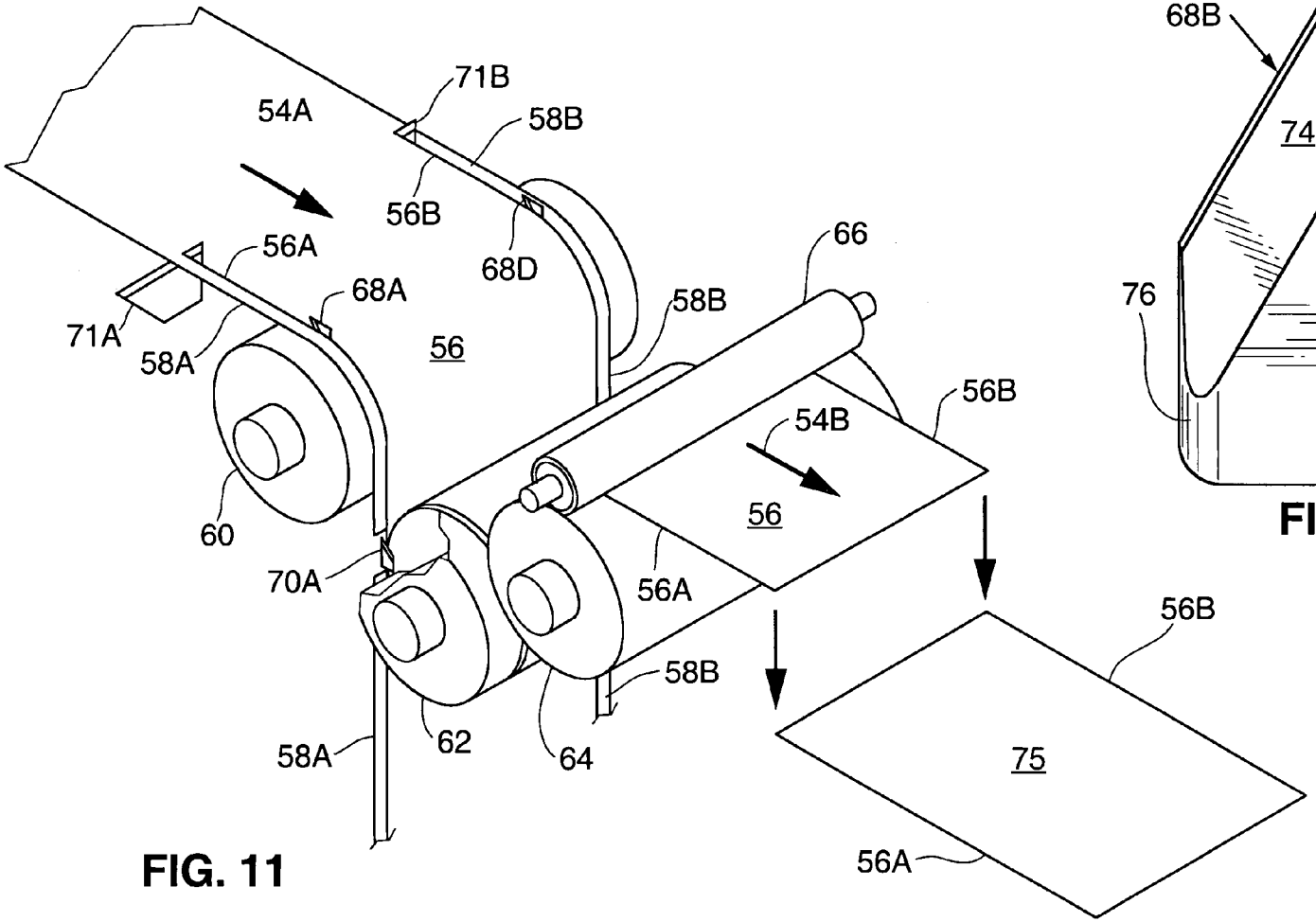
FIG. 11 is a perspective view of the FIG. 10A apparatus.

It is also possible to condition the paper during the paper manufacturing process, prior to the paper being cut into individual sheets. FIGS. 10A, 10B and 11 are schematic representations of a conditioning apparatus which receives a paper web 56, also sometimes referred to herein as a continuous sheet 56, conditions one or both edges of web and cuts the conditioned web into individual sheets 75. In the present example, the original web 56 has a width somewhat greater than the desired final width of the sheets. The web 56 is drawn in a direction indicated by arrow 54A around large rollers 60, 62 and 64, with roller 66 being a pinch roller engaging the larger non-grooved roller 64. Prior to reaching roller 60, the web 56 is slit to the proper width by a pair of suitably spaced apart slitting blades 71A and 71B. Note that if the web width is all ready cut to the appropriate size, this slitting operation is not needed. The slitting produces a pair of end strips 58A and 58B which continue to wrap around part of roller 60 after slitting.

Roller 60 includes a pair of grooves 72A and 72B which are aligned with the respective slitter blades 71A and 71B, with the grooves extending around the circumference of the roller. The second roller 62 also includes a second pair of grooves which are not visible and which are similar to grooves 72A and 72B. The cut web 56 extends around roller 62, with the direction of rotation of rollers 60 and 62 being opposite as indicated by respective arrows 52A and 52B (FIG. 10A). Finally, the cut web 56 is pulled over roller 64, with the web being secured in place by pinch roller 66. The apparatus for driving the rollers is conventional and not depicted.

Figure 12:
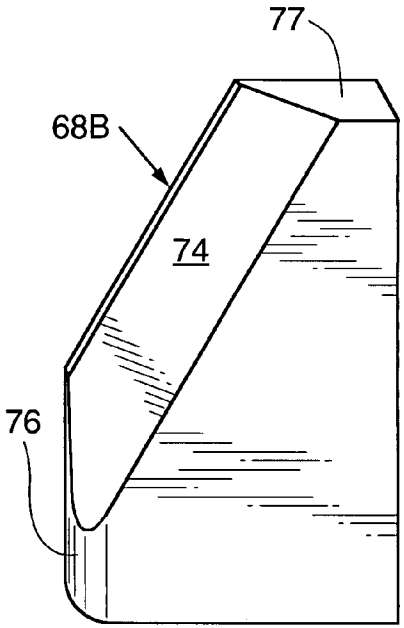
FIG. 12 is a perspective view of one of the four bending blades used in the FIG. 10A apparatus.

A pair of bending blades 68A and 68B are positioned above the respective grooves 72A and 72B formed in roller 60. Blades 68A and 68B, in cooperation with an interior wall of the grooves, perform a bending function similar to that previously described in connection with bending blade 42. FIG. 12 shows one of the bending blades 68A associated with groove 72A. The blade 68A extends partially into groove 72A (FIGS. 10A and 10B) and functions to fold an outer edge 56A of the web 56 into groove 72A, with the blade forcing the outer edge against inner wall 73A of the groove. As will be explained, the outer surface of the roller 60 and the inner wall form a sharp corner similar to corners A and B formed by respective clamps 38A and 38B of FIG. 4B. Blades 68A and 68B form a first bending station associated with roller 60, with bending blades 70A and 70B (70B not shown) associated with roller 62 forming a second bending station which bends the respective web edges 56A and 56B in a direction opposite to that of the first station.

Referring again to FIG. 12, a perspective view on one of the bending blades 68B that is associated with groove 72B of roller 60 is shown, with the other three blades being of similar construction. The function of the bending blades is engage the web edge that is parallel to the outer surface of the roller and to fold the web edge into the associated groove and force the web edge against an interior wall of the groove as the web is drawn past the blade. As will be subsequently described in detail, blade 68B includes a bending surface 74 disposed at an angle which functions to rotate the web edge from the horizontal position to almost a vertical position. A second surface 76 then engages the almost folded web edge and forces the web edge against the vertical interior wall of the associated groove.

Figure 13:
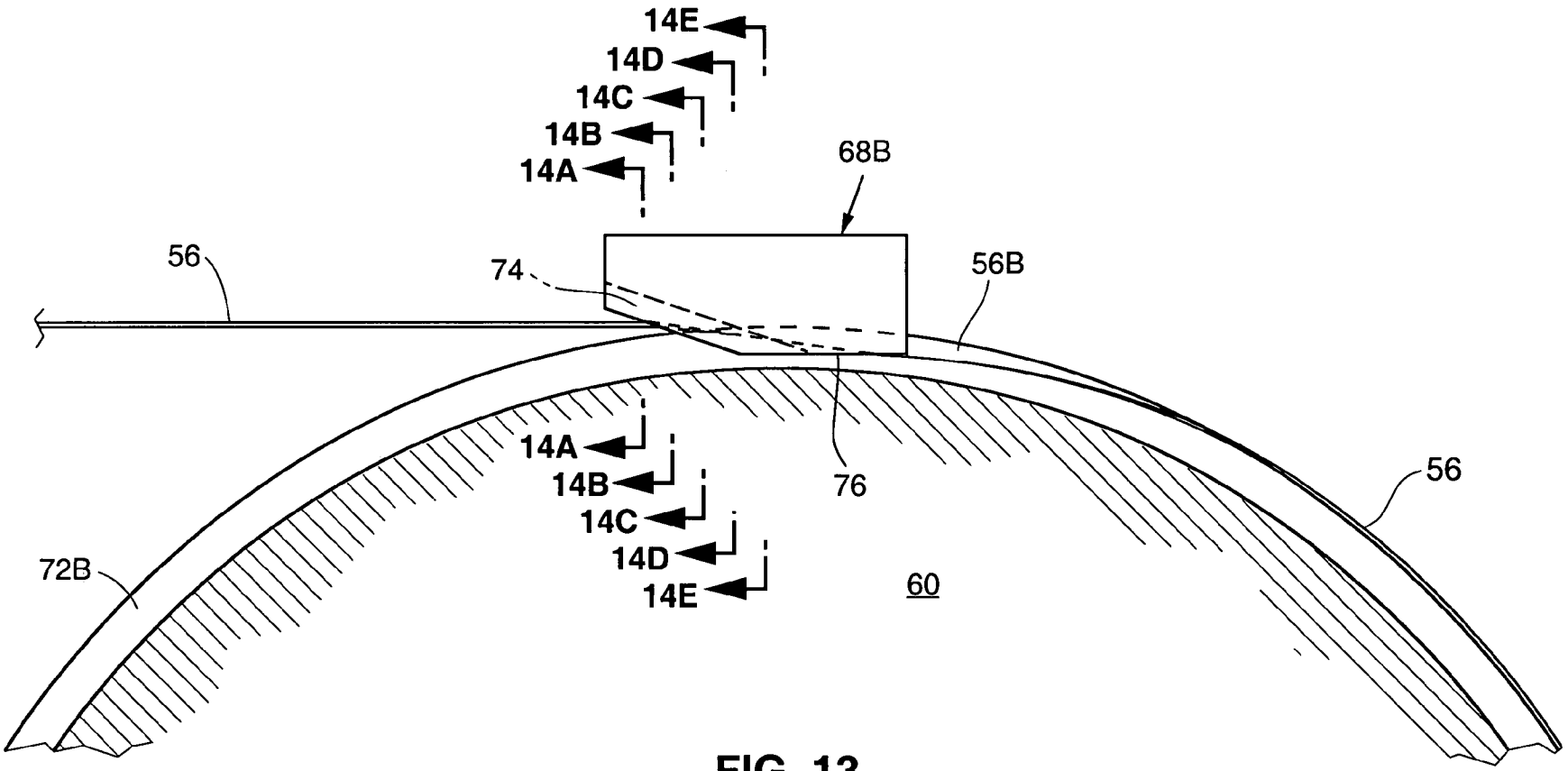
FIG. 13 is an elevational partial view of one of the grooved drums of the FIG. 10A apparatus showing the manner in which the bending blade of FIG. 12 functions to bend an edge of the paper web.

FIG. 13 is a cross-section schematic representation of part of roller 60 showing exemplary groove 72B and the associated bending blade 68B. FIGS. 14A-14E show five cross-sections of bending blade 68B and the associated web edge as it is being folded when the web is pulled past the blade. Starting with FIG. 14A, which shows the cross-section 14A-14A of blade 68B, at this stage the edge of the web 56B is still in the original horizontal position, with surface 74 of the blade not yet contacting the edge. For purposes of clarity, this view does not show portions of the web edge 56B which have already been folded by blade 68B. Note that at this point, the blade 68B is abutting a stop (not depicted) which causes the blade to be displaced from the interior wall 73B of the groove a distance that corresponds to distance X of FIG. 3B, with that distance being again set to be somewhat smaller than the thinnest web sheet to be conditioned. Also, there is again a biasing mechanism that will force the blade 68B against the web once the web has displaced the blade away from the interior wall a distance greater than X. The mechanism for supporting the blade and for applying the biasing force is not depicted. Also, the end strips 58B (FIG. 11) cut by slitting blade 71B is not depicted in FIG. 14A.

Figure 14A:
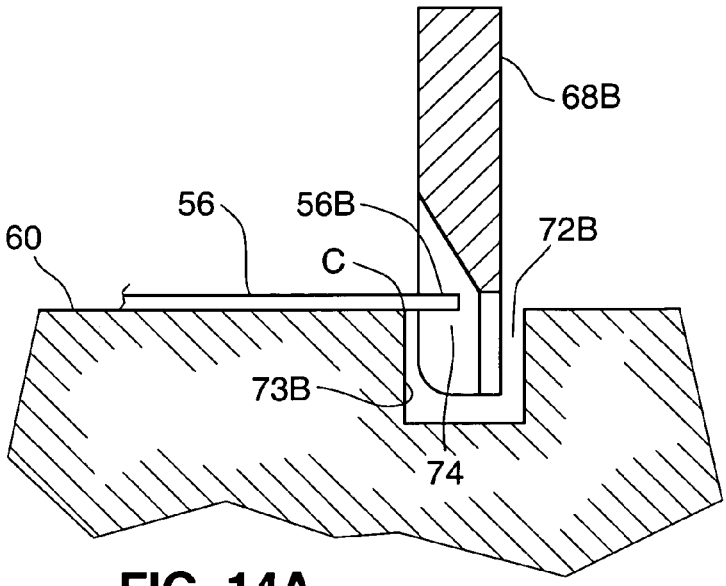
FIGS. 14A-14E are respective cross-sectional views of the FIG. 13 arrangement showing various stages in the process of bending the web edge using the bending blade of FIG. 12.
Figure 14B:
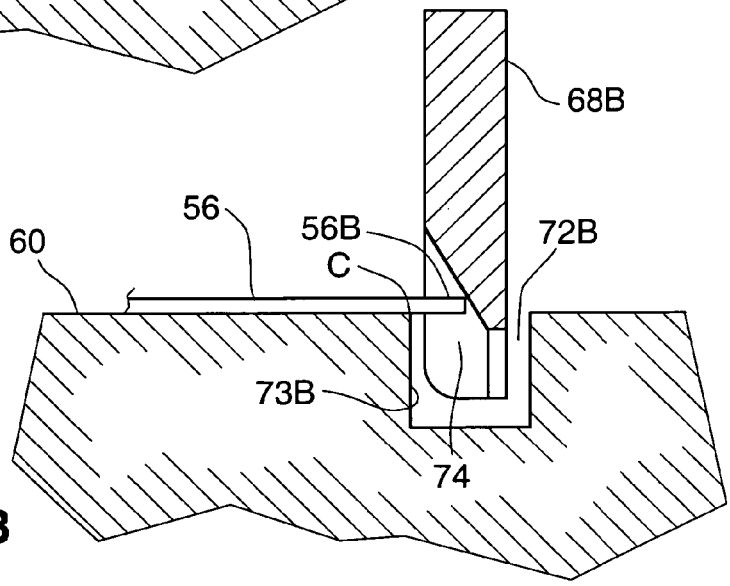
Figure 14C:
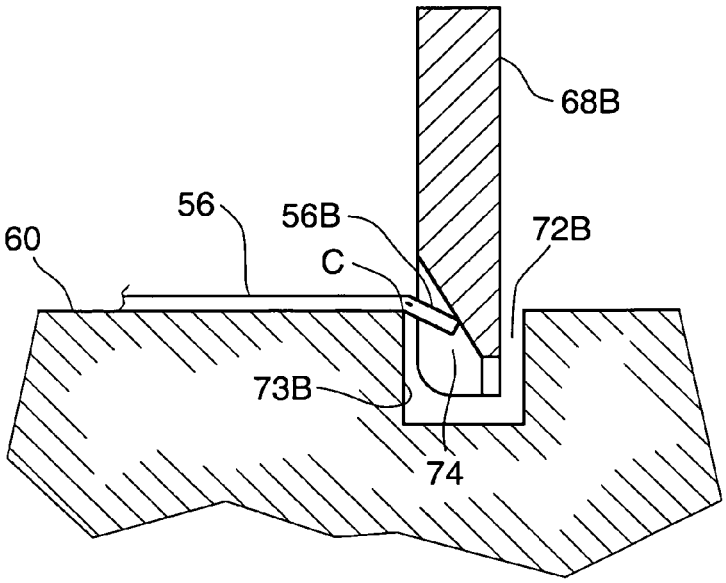
Figure 14D:
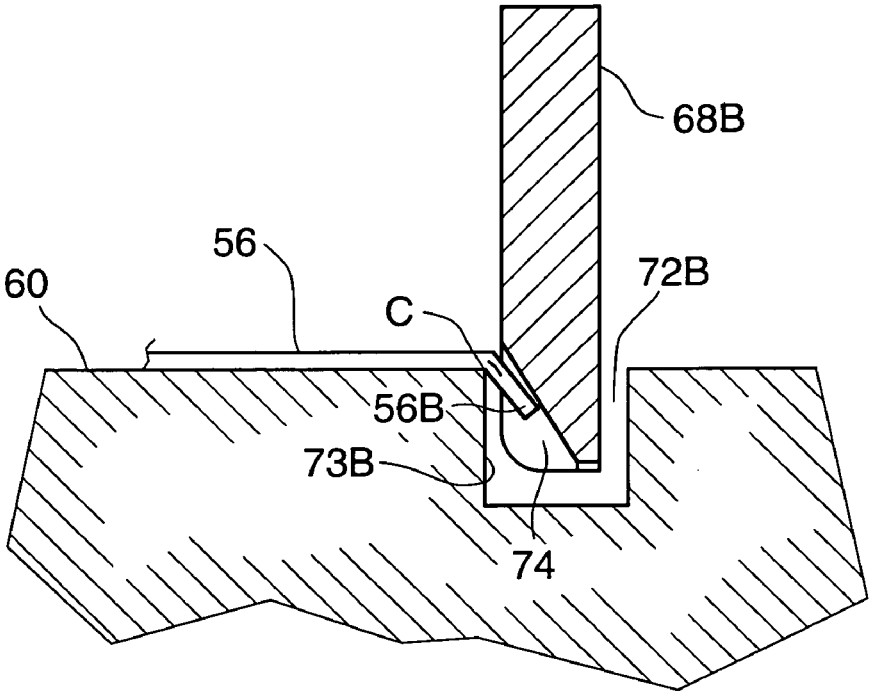
Figure 14E:
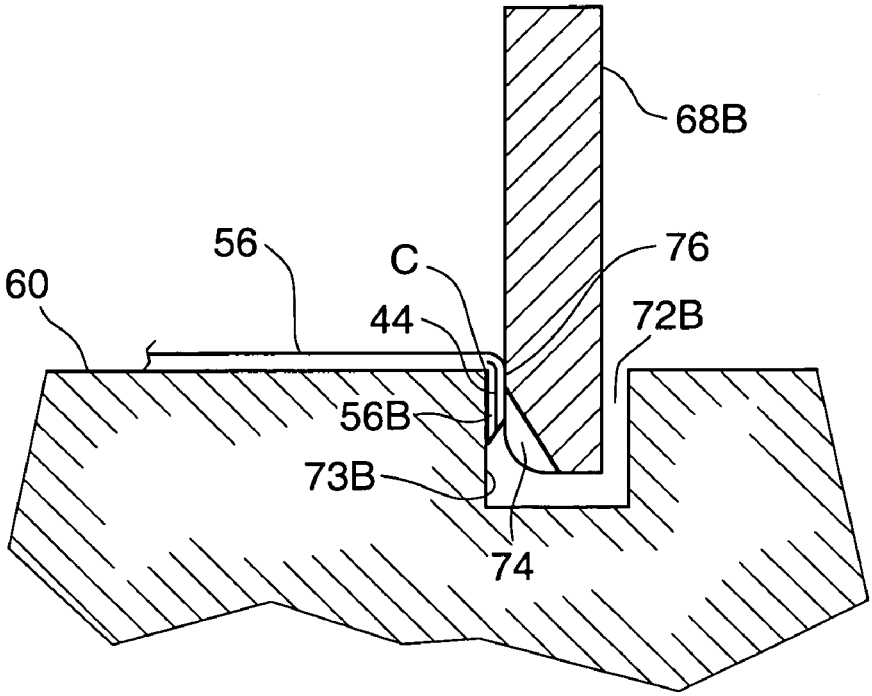

FIG. 14B shows the cross-section along line 14B-14B of FIG. 13 where the associated web edge 56B first contacts angled surface 74 but has not yet begun to be bent by the surface. As the web 56 progresses past the bending blade as shown in FIG. 14C, the angled surface 74 commences to deflect the web edge 56B down into the groove 72B. FIG. 14D shows a cross-section of 14D-14D of FIG. 13 showing the angled surface 74 as it continues to fold the web edge 56B around the relatively sharp corner C formed by the upper surface of roller 60 and the inner wall 73B of groove 72B. As the folding progresses, the web 56B has been driven past the angled surface 74 and has engaged the flat surface 76 (FIG. 12) of the bending blade 68B, with this surface forcing the web flat against the inner wall 73B of the groove. The previously-noted biasing mechanism (not depicted) forces the blade against the web edge 56B so that the web is tightly folded around corner C, with this action tending to create a tear or fracture 44 in the edge in the same manner as previously described in connection with FIG. 4B, for example. Again, the radius of corner C is selected to be small but not so small as to cut or otherwise mar the surface of the web edge 56B. Eventually, the folded web edge 56B passes the bending member 68B completing a single bend in the web. Bending blade 68A, also of the first bending station, conditions the opposite edge 56B of the web at the same time edge 56B is being conditioned.

Figure 15A:
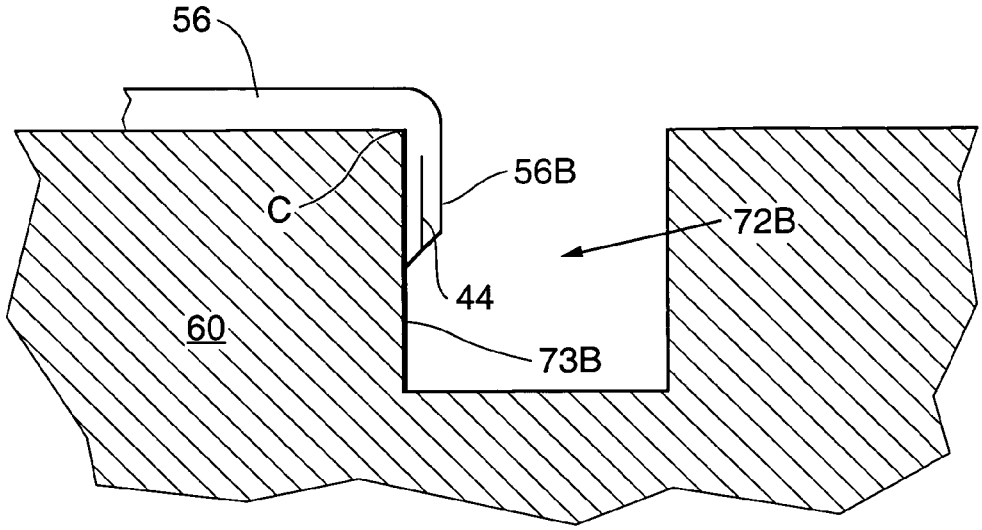
FIGS. 15A and 15B illustrate the manner in which the conditioning apparatus of FIGS. 10A and 11 functions to bend each edge of the web is opposite directions.
Figure 15B:
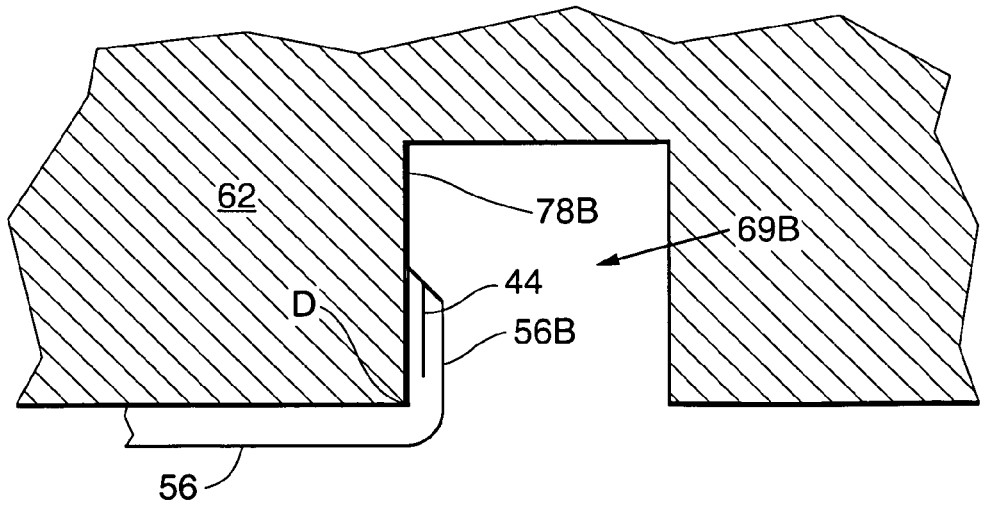

The conditioned web 56 is then drawn around roller 62, with the cut strips 58A and 58B being permitted to fall away at this point. The previously bent edges 56A and 56B are then flattened as the web begins to pass around roller 62, with the surface of the web facing roller 62 being the opposite of the web surface facing roller 60. As previously explained roller 62 has a pair of grooves and associated bending blades 70A and 70B which form the second bending station. The blades engage the respective edges 56A and 56B of the web and function to bend the edges in the same manner as the blades of the first bending station, but in an opposite direction. FIGS. 15A and 15B are respective expanded cross-sections of the groove 72B formed in roller 60 of the first bending station and a corresponding groove 69B formed in roller 62 of the second bending station. The bending blades are not depicted. As can be seen, the first bending station of FIG. 15A folds the web edge 56B in a first direction around corner C, with the second bending station of FIG. 15B folding the same web edge around corner D formed in roller 62 in the opposite direction.

As previously explained in connection with FIG. 4C, the outer surface of roller 60 could be considered to form a first folding surface, with the inner surface 73B of groove 72B formed in roller 60 of FIG. 15A being a second folding surface, with the two folding surfaces meeting at point C. The two folding surfaces form an angle similar to angle F1 of FIG. 4C. Preferably, the corresponding angle F1 for the FIG. 15A apparatus, the angle between the first and second folding surfaces, is 90 degrees, with the typical value being less than 120 degrees. The tension applied to web 56 which holds the web against the surface of drum 60, the first folding surface, along with the force applied by bending blade 68B against the inner surface 73B, the second folding surface, function to fold the web tightly over the first and second folding surfaces as is desired.

As also previously explained in connection with FIG. 6B, , the outer surface of roller 62 could be considered to form a third folding surface, with the inner surface 78B of groove 69B formed in roller 62 of FIG. 15B being a fourth folding surface, with the two folding surfaces meeting at point D. The two folding surfaces form an angle similar to angle F2 of FIG. 6B. Preferably, the corresponding angle F1 for the FIG. 15B apparatus is 90 degrees, with the value typically being less than 120 degrees. The tension applied to web 56 which holds the web against the surface of drum 62, the third folding surface, along with the force applied by bending blade 68B against the inner surface 78B, the fourth folding surface, function to fold the web tightly over the third and fourth folding surfaces as is desired. It can be seen that the physical placement of the cutting blades 71A/71B define the locations of the edges of the sheet and further seen in Figs 15A/15B that the location of the groves 72A/72B in roller 60 and groves 69A/69B together define the respective locations of the folding lines from the edges of the sheet. Thus, these features together function as a sheet positioning mechanism which control the location of the various folding lines relative to the edges of the sheet.

The two opposite bending operations are usually more than sufficient to effectively condition the edges of the web. If required, further bending stations can be added by adding one or more grooved rollers and associated bending blades. As shown in FIGS. 10A and 11, the conditioned web 56 is then drawn between a large non-grooved roller 64 and pinch roller 66 thereby straightening the conditioned edges in a manner similar to that shown in FIG. 8B. Finally the conditioned web or continuous sheet 56 is cut into individual sheets 75 of the desired final length. The sheets can then be bound along either conditioned edge 56A or 56B. Conditioning both edges in this manner is valuable since the conditioning is not visible except upon close inspection. Thus, the conditioned edge not used for binding is not easily visible. On the other hand, if only one edge were conditioned, the end user would have to first determine the appropriate edge for binding and then take that factor into account when assembling the sheets into a stack for binding.

Note that the apparatus of FIG. 3A is implemented to fold the sheet 36 around corner A and B, with A and B being positioned so that there is a common folding line when the sheet is folded in opposite directions. As can be seen in FIGS. 15A and 15B, the relative lateral positions of grooves 69B and 72B can be altered so that folding lines are not in common and thus produce differing values of length Z (FIG. 3B). Although this is a less preferred implementation, the two folding lines should both be placed a distance from the edge of the web so that the ratio of the of the distance Z from the edge of the sheet to the thickness Y of the web (Z/Y) is, in both cases, in the approximate range of 4 to 6 and, in any event, less than twenty (20). Note that the apparatus of FIG. 3A could also be implemented to produce differing folding lines, with this implementation also being less preferred.

Thus, various apparatus and related methods have been disclosed which permit a bound stack of sheet to be bound using conventional thermal adhesives for many paper types that could not otherwise be bound using such binding methods. Although such apparatus and methods have been described in some detail, it is to be understood that various changes can be made by those skilled in the art without departing from the spirit and scope of the present invention as set forth in the appended claims.

The invention claimed is:

1. Apparatus of conditioning an edge of a single sheet of paper comprising:

a first folding member which includes first and second folding surfaces disposed at a first intermediate angle of less than 120 degrees, with the first and second folding surfaces meeting at a first location;

a second folding member which includes third and fourth folding surfaces disposed at a second intermediate angle of less than 120 degrees, with the third and fourth folding surfaces meeting at a second location;

first apparatus configured to fold a section of the sheet which extends to the edge of the sheet over the first folding member in a first folding direction so that a first bending line is formed in the sheet at the first location along substantially a full length of the edge of the sheet, with the first apparatus in combination with the first and second folding members forming part of a sheet positioning mechanism so that the first bending line is at a distance from the edge of the sheet less than twenty times a thickness of the sheet, and with the sheet being folded at the first intermediate angle and further configured to fold a section of the sheet which extends to the edge of the sheet over the second folding member in a second folding direction, opposite the first folding direction, so that a second bending line is formed in the sheet at said second location along substantially a full length of the edge of the sheet, with the second bending line being a distance from the edge of the sheet less than twenty times the thickness of the sheet, and with the sheet being folded at the second intermediate angle.

2. The apparatus of claim 1 wherein the sheet to be conditioned is a cut sheet and wherein the apparatus further includes first and second clamps, with the first clamp comprising the first folding member, with a first gripping surface of the first clamp forming the first folding surface and with the second clamp comprising the second folding member, with a second gripping surface of the second clamp forming the third folding surface, with the first and second clamps movable between an open position for receiving a sheet to be conditioned and a closed position where the sheet can be secured between the first and second gripping surfaces, with the edge being conditioned extending from between the first and second gripping surfaces.

3. The apparatus of claim 2 wherein the first clamp includes a first clamp surface which forms the second folding surface, with the first intermediate angle between the first and second folding surfaces being substantially 90 degrees and wherein the second clamp includes a second clamp surface which forms the fourth folding surface, with the second intermediate angle between the third and fourth folding surfaces being substantially 90 degrees.

4. The apparatus of claim 3 wherein the first apparatus includes a bending member, with the bending member and the first and second clamps, when in the closed position, being movable relative to one another, with relative movement in a first movement direction causing a portion of a sheet gripped between the first and second clamps to be forced against the second folding surface to form the first bending line in the sheet and with relative movement in a second movement direction, opposite the first movement direction, causing a portion of the sheet to be forced against the fourth folding surface to form the second bending line.

5. The apparatus of claim 1 wherein the sheet to be conditioned is part of a continuous sheet, with the apparatus further including a first roller which is mounted for rotation, with the first roller including the first folding member and having surfaces that form the first and second folding surfaces and a second roller which is mounted for rotation, with the second roller including the second folding member and having surfaces that form the third and fourth folding surfaces.

6. The apparatus of claim 5 further including a drive mechanism which causes the first and second rollers to be rotated in opposite directions.

7. The apparatus of claim 6 wherein the first roller includes a first groove formed in an outer surface of the first roller with the first groove extending around a full circumference of the first roller and wherein the second roller includes a second groove extending around a full circumference of the second roller, with the outer surface of the first roller and a surface defined by the first groove forming the respective first and second folding surfaces and with the outer surface of the second roller and a surface defined by the second groove forming the respective third and fourth folding surfaces.

8. The apparatus of claim 7 wherein the first apparatus includes a first bending member, at least a portion of which is disposed within the first groove and further includes a second bending member, at least a portion of which is disposed within the second groove.

9. The apparatus of claim 1 wherein the sheet to be conditioned is part of a continuous sheet, with the apparatus further including a first roller which is mounted for rotation, with the first roller including the first folding member, with the first roller being capable of receiving the sheet to be conditioned so that the sheet extends around at least a portion of the first roller.

10. The apparatus of claim 9 wherein the first apparatus includes a first bending member positioned adjacent to the first roller, with the first roller being rotatable with respect to the first bending member.

11. The apparatus of claim 10 further including a second roller mounted for rotation, with the second roller including the second folding member, with the second roller being capable of receiving the sheet to be conditioned so that the sheet extends around at least a portion of the second roller and wherein the first apparatus includes a second bending member positioned adjacent to the second roller, with the second roller being rotatable with respect to the second bending member.

12. The apparatus of claim 11 wherein the first roller includes a cylindrical outer surface which includes the first folding surface and wherein the second roller includes a cylindrical outer surface which includes the third folding surface.

13. The apparatus of claim 12 wherein the first roller includes a first circumferential surface extending around the first roller which includes the second folding surface and wherein the second roller includes a second circumferential surface extending around the second roller which forms the fourth folding surface.

14. The apparatus of claim 13 wherein the first roller includes a first circumferential groove which extends around the first roller and which includes the first circumferential surface and wherein the second roller includes a second circumferential groove which extends around the second roller and which includes the second circumferential surface.

15. The apparatus of claim 14 wherein at least a portion of the first bending member extends within the first circumferential groove and at least a portion of the second bending member extends within the second circumferential groove.

16. Apparatus of conditioning an edge of a single sheet of paper comprising:

a first folding member which includes first and second folding surfaces disposed at a first intermediate angle of less than 120 degrees, with the first and second folding surfaces meeting at a first location;

a second folding member which includes third and fourth folding surfaces disposed at a second intermediate angle of less than 120 degrees, with the third and fourth folding surfaces meeting at a second location;

first apparatus configured to fold a section of the sheet which extends to the edge of the sheet over the first folding member in a first folding direction so that a first bending line is formed in the sheet at the first location along substantially a full length of the edge of the sheet, with the first apparatus together with the first and second folding members forming part of a sheet positioning mechanism so that the first bending line is disposed in a region of the sheet between 0.030 and 0.050 inches from the edge of the sheet, and with the sheet being folded at the first intermediate angle and further configured to fold a section of the sheet which extends to the edge of the sheet over the second folding member in a second folding direction, opposite the first folding direction, so that a second bending line is formed in the sheet at said second location along substantially a full length of the edge of the sheet, with the second bending line being disposed in a region of the sheet between 0.030 and 0.050 inches from the edge of the sheet, and with the sheet being folded at the second intermediate angle.

17. The apparatus of claim 16 wherein the sheet to be conditioned is a cut sheet and wherein the apparatus further includes first and second clamps, with the first clamp comprising the first folding member, with a first gripping surface of the first clamp forming the first folding surface and with the second clamp comprising the second folding member, with a second gripping surface of the second clamp forming the third folding surface, with the first and second clamps movable between an open position for receiving a sheet to be conditioned and a closed position where the sheet can be secured between the first and second gripping surfaces, with the edge being conditioned extending from between the first and second gripping surfaces.

18. The apparatus of claim 17 wherein the first clamp includes a first clamp surface which forms the second folding surface, with the first intermediate angle between the first and second folding surfaces being substantially 90 degrees and wherein the second clamp includes a second clamp surface which forms the fourth folding surface, with the second intermediate angle between the third and fourth folding surfaces being substantially 90 degrees.

19. The apparatus of claim 18 wherein the first apparatus includes a bending member, with the bending member and the first and second clamps, when in the closed position, being movable relative to one another, with relative movement in a first movement direction causing a portion of a sheet gripped between the first and second clamps to be forced against the second folding surface to form the first bending line in the sheet and with relative movement in a second movement direction, opposite the first movement direction, causing a portion of the sheet to be forced against the fourth folding surface to form the second bending line.

20. The apparatus of claim 16 wherein the sheet to be conditioned is part of a continuous sheet, with the apparatus further including a first roller which is mounted for rotation, with the first roller including the first folding member and having surfaces that form the first and second folding surfaces and a second roller which is mounted for rotation, with the second roller including the second folding member and having surfaces that form the third and fourth folding surfaces.

21. The apparatus of claim 20 further including a drive mechanism which causes the first and second rollers to be rotated in opposite directions.

22. The apparatus of claim 21 wherein the first roller includes a first groove formed in an outer surface of the first roller with the first groove extending around a full circumference of the first roller and wherein the second roller includes a second groove extending around a full circumference of the second roller, with the outer surface of the first roller and a surface defined by the first groove forming the respective first and second folding surfaces and with the outer surface of the second roller and a surface defined by the second groove forming the respective third and fourth folding surfaces.

23. The apparatus of claim 22 wherein the first apparatus includes a first bending member, at least a portion of which is disposed within the first groove and further includes a second bending member, at least a portion of which is disposed within the second groove.

24. The apparatus of claim 16 wherein the sheet to be conditioned is part of a continuous sheet, with the apparatus further including a first roller which is mounted for rotation, with the first roller including the first folding member, with the first roller being capable of receiving the sheet to be conditioned so that the sheet extends around at least a portion of the first roller.

25. The apparatus of claim 24 wherein the first apparatus includes a first bending member positioned adjacent to the first roller, with the first roller being rotatable with respect to the first bending member.

26. The apparatus of claim 25 further including a second roller mounted for rotation, with the second roller including the second folding member, with the second roller being capable of receiving the sheet to be conditioned so that the sheet extends around at least a portion of the second roller and wherein the first apparatus includes a second bending member positioned adjacent to the second roller, with the second roller being rotatable with respect to the second bending member.

27. The apparatus of claim 26 wherein the first roller includes a cylindrical outer surface which includes the first folding surface and wherein the second roller includes a cylindrical outer surface which includes the third folding surface.

28. The apparatus of claim 27 wherein the first roller includes a first circumferential surface extending around the first roller which includes the second folding surface and wherein the second roller includes a second circumferential surface extending around the second roller which forms the fourth folding surface.

29. The apparatus of claim 28 wherein the first roller includes a first circumferential groove which extends around the first roller and which includes the first circumferential surface and wherein the second roller includes a second circumferential groove which extends around the second roller and which includes the second circumferential surface.

30. The apparatus of claim 29 wherein at least a portion of the first bending member extends within the first circumferential groove and at least a portion of the second bending member extends within the second circumferential groove.

31. Apparatus of conditioning an edge of a single sheet of paper having first and second opposite surfaces, said apparatus comprising:

a first folding member which includes first and second folding surfaces disposed at a first intermediate angle of less than 120 degrees, with the first and second folding surfaces meeting at a first location;

a second folding member which includes third and fourth folding surfaces disposed at a second intermediate angle of less than 120 degrees, with the third and fourth folding surfaces meeting at a second location;

first apparatus configured to fold a section of the sheet which extends to the edge of the sheet over the first folding member in a first folding direction so that a first bending line is formed in the sheet at the first location along substantially a full length of the edge of the sheet, and with the sheet being folded at the first intermediate angle and further configured to fold a section of the sheet which extends to the edge of the sheet over the second folding member in a second folding direction, opposite the first folding direction, so that a second bending line is formed in the sheet at said second location along substantially a full length of the edge of the sheet, and with the sheet being folded at the second intermediate angle, with the first apparatus together with the first and second folding members forming part of a sheet positioning mechanism so that the first and second locations are respectively located a sufficiently short distance from the edge of the sheet such that when the sheet is folded in the first and second folding directions, the edge of the sheet will tend to split in a region intermediate the first and second opposite surfaces.

32. The apparatus of claim 31 wherein the sheet to be conditioned is a cut sheet and wherein the apparatus further includes first and second clamps, with the first clamp comprising the first folding member, with a first gripping surface of the first clamp forming the first folding surface and with the second clamp comprising the second folding member, with a second gripping surface of the second clamp forming the third folding surface, with the first and second clamps movable between an open position for receiving a sheet to be conditioned and a closed position where the sheet can be secured between the first and second gripping surfaces, with the edge being conditioned extending from between the first and second gripping surfaces.

33. The apparatus of claim 32 wherein the first clamp includes a first clamp surface which forms the second folding surface, with the first intermediate angle between the first and second folding surfaces being substantially 90 degrees and wherein the second clamp includes a second clamp surface which forms the fourth folding surface, with the second intermediate angle between the third and fourth folding surfaces being substantially 90 degrees.

34. The apparatus of claim 33 wherein the first apparatus includes a bending member, with the bending member and the first and second clamps, when in the closed position, being movable relative to one another, with relative movement in a first movement direction causing a portion of a sheet gripped between the first and second clamps to be forced against the second folding surface to form the first bending line in the sheet and with relative movement in a second movement direction, opposite the first movement direction, causing a portion of the sheet to be forced against the fourth folding surface to form the second bending line.

35. The apparatus of claim 31 wherein the sheet to be conditioned is part of a continuous sheet, with the apparatus further including a first roller which is mounted for rotation, with the first roller including the first folding member and having surfaces that form the first and second folding surfaces and a second roller which is mounted for rotation, with the second roller including the second folding member and having surfaces that form the third and fourth folding surfaces.

36. The apparatus of claim 35 further including a drive mechanism which causes the first and second rollers to be rotated in opposite directions.

37. The apparatus of claim 36 wherein the first roller includes a first groove formed in an outer surface of the first roller with the first groove extending around a full circumference of the first roller and wherein the second roller includes a second groove extending around a full circumference of the second roller, with the outer surface of the first roller and a surface defined by the first groove forming the respective first and second folding surfaces and with the outer surface of the second roller and a surface defined by the second groove forming the respective third and fourth folding surfaces.

38. The apparatus of claim 37 wherein the first apparatus includes a first bending member, at least a portion of which is disposed within the first groove and further includes a second bending member, at least a portion of which is disposed within the second groove.

39. The apparatus of claim 31 wherein the sheet to be conditioned is part of a continuous sheet, with the apparatus further including a first roller which is mounted for rotation, with the first roller including the first folding member, with the first roller being capable of receiving the sheet to be conditioned so that the sheet extends around at least a portion of the first roller.

40. The apparatus of claim 39 wherein the first apparatus includes a first bending member positioned adjacent to the first roller, with the first roller being rotatable with respect to the first bending member.

41. The apparatus of claim 40 further including a second roller mounted for rotation, with the second roller including the second folding member, with the second roller being capable of receiving the sheet to be conditioned so that the sheet extends around at least a portion of the second roller and wherein the first apparatus includes a second bending member positioned adjacent to the second roller, with the second roller being rotatable with respect to the second bending member.

42. The apparatus of claim 41 wherein the first roller includes a cylindrical outer surface which includes the first folding surface and wherein the second roller includes a cylindrical outer surface which includes the third folding surface.

43. The apparatus of claim 42 wherein the first roller includes a first circumferential surface extending around the first roller which includes the second folding surface and wherein the second roller includes a second circumferential surface extending around the second roller which forms the fourth folding surface.

44. The apparatus of claim 43 wherein the first roller includes a first circumferential groove which extends around the first roller and which includes the first circumferential surface and wherein the second roller includes a second circumferential groove which extends around the second roller and which includes the second circumferential surface.

45. The apparatus of claim 44 wherein at least a portion of the first bending member extends within the first circumferential groove and at least a portion of the second bending member extends within the second circumferential groove.

* * * * *